US007852364B2

(12) United States Patent
Tsujino et al.

(10) Patent No.: US 7,852,364 B2
(45) Date of Patent: Dec. 14, 2010

(54) LINE HEAD AND AN IMAGE FORMING APPARATUS USING THE LINE HEAD

(75) Inventors: Kiyoshi Tsujino, Matsumoto (JP); Nozomu Inoue, Matsumoto (JP); Yujiro Nomura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 50 days.

(21) Appl. No.: 12/274,196

(22) Filed: Nov. 19, 2008

(65) Prior Publication Data

US 2009/0141114 A1 Jun. 4, 2009

(30) Foreign Application Priority Data

Nov. 30, 2007 (JP) ..... 2007-309736
Sep. 8, 2008 (JP) ..... 2008-229973

(51) Int. Cl.
*B41J 2/435* (2006.01)
*B41J 2/47* (2006.01)

(52) U.S. Cl. ..... 347/237; 347/247

(58) Field of Classification Search ..... 347/238, 347/237, 247
See application file for complete search history.

(56) References Cited

U.S. PATENT DOCUMENTS 5,307,089 A * 4/1994 Takasu et al. ..... 347/238
6,559,879 B1 * 5/2003 Kobayashi et al. ..... 347/238
7,411,601 B2 * 8/2008 Kurose et al. ..... 347/238

FOREIGN PATENT DOCUMENTS

| | | |
|---|---|---|
| JP | 11-268333 | 10/1999 |
| JP | 2007-160650 | 6/2007 |
| JP | 2007-203555 | 8/2007 |
| JP | 2007-290303 | 11/2007 |

* cited by examiner

*Primary Examiner*—Hai C Pham
(74) *Attorney, Agent, or Firm*—DLA Piper LLP (US)

(57) ABSTRACT

A line head, includes: a head substrate; a first light emitting element group which is arranged on the head substrate and includes a first light emitting element and a second light emitting element; a second light emitting element group and a third light emitting element group which are arranged in a first direction on the head substrate; a first wiring which is arranged between the second and the third light emitting element groups on the head substrate and is electrically connected with the first light emitting element; a second wiring which is arranged between the second and the third light emitting element groups on the head substrate and is electrically connected with the second light emitting element; and a connecting portion which is arranged on the head substrate and is electrically connected with the first and the second wirings.

14 Claims, 20 Drawing Sheets

LINE HEAD AND AN IMAGE FORMING APPARATUS USING THE LINE HEAD

CROSS REFERENCE TO RELATED APPLICATION

The disclosure of Japanese Patent Applications No. 2007-309736 filed on Nov. 30, 2007 and No. 2008-229973 filed on Sep. 8, 2008 including specification, drawings and claims is incorporated herein by reference in its entirety.

BACKGROUND

1. Technical Field

This invention relates to a line head for imaging a light beam emitted from a light emitting element by a lens and an image forming apparatus using such a line head.

2. Related Art

In such a line head, as disclosed in JP-A-2007-290303 for example, a plurality of light emitting elements are arrayed in a longitudinal direction (X-direction in JP-A-2007-290303) in two rows in an offset manner (see FIG. 3 and other figures of JP-A-2007-290303). These light emitting elements are formed on a head substrate and the light emitting operations of the respective light emitting elements are controlled by a controller outside the head substrate. Such a control of the light emitting elements by the controller outside the head substrate can be realized, for example, using connecting members such as flexible printed boards or FPCs (flexible printed circuits).

Specifically, one end of the FPC is attached to the head substrate and the other end thereof is drawn to the outside of the head substrate. The one end of this FPC is connected with wirings drawn from the respective light emitting elements. Accordingly, when an emission control signal from the controller is inputted to the other end of the FPC, the light emitting elements emit light beams in accordance with this emission control signal. In this way, the light emissions of the light emitting elements can be controlled by the external controller. Further, the light beams from the light emitting elements are imaged by a gradient index rod lens array to form a latent image on a surface of a latent image carrier such as a photosensitive member.

SUMMARY

In the above construction, it was difficult in some cases to draw the wirings connected with the light emitting elements only toward one side of the head substrate. In other words, in the above construction, the plurality of light emitting elements are arrayed in the longitudinal direction (X-direction in JP-A-2007-290303) in two rows in an offset manner and it was difficult to arrange the wirings between the light emitting elements in some cases. It is even more difficult to arrange the wirings between the light emitting elements in such a case where intervals between the respective light emitting elements are narrowed to perform a latent image forming operation with a higher resolution. As a result, in a line head as described above, it was necessary in some cases to draw the wirings toward the opposite sides of the light emitting elements in a width direction. More specifically, it was necessary in some cases not to arrange the wirings between the light emitting elements by drawing the wirings toward one widthwise side from the light emitting elements in one row while drawing the wirings toward the other widthwise side from the light emitting elements in the other row. Here, the width direction is orthogonal to or substantially orthogonal to the longitudinal direction.

In the case of drawing the wirings toward the opposite sides in this way, FPCs or the like to be connected with these wirings are also mounted on the opposite sides of the head substrate. However, in light of simplifying a line head production process and suppressing production cost, it is desirable to mount members such as FPCs only on one side of the head substrate. This is because it is sufficient to perform a process for mounting the members such as the FPCs only once on one side of the head substrate.

An advantage of some aspects of the invention is to provide technology enabling a line head production process to be simplified and production cost to be suppressed by enabling wirings to be easily drawn toward one side from a light emitting element.

According to a first aspect of the invention, there is provided a line head, comprising: a head substrate; a first light emitting element group which is arranged on the head substrate and includes a first light emitting element and a second light emitting element; a second light emitting element group and a third light emitting element group which are arranged in a first direction on the head substrate; a first wiring which is arranged between the second and the third light emitting element groups on the head substrate and is electrically connected with the first light emitting element; a second wiring which is arranged between the second and the third light emitting element groups on the head substrate and is electrically connected with the second light emitting element; and a connecting portion which is arranged on the head substrate and is electrically connected with the first and the second wirings.

According to a second aspect of the invention, there is provided an image forming apparatus, comprising: a head substrate; a first light emitting element group which is arranged on the head substrate and includes a first light emitting element and a second light emitting element; a second light emitting element group and a third light emitting element group which are arranged in a first direction on the head substrate; a first wiring which is arranged between the second and the third light emitting element groups on the head substrate and is electrically connected with the first light emitting element; a second wiring which is arranged between the second and the third light emitting element groups on the head substrate and is electrically connected with the second light emitting element; a connecting portion which is arranged on the head substrate and is electrically connected with the first and the second wirings; and a controller which is adapted to output an emission control signal which controls light emissions of the light emitting elements.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

A. Description of Terms

Terms used in this specification are described before the description of embodiments of the invention.

Figure 1:
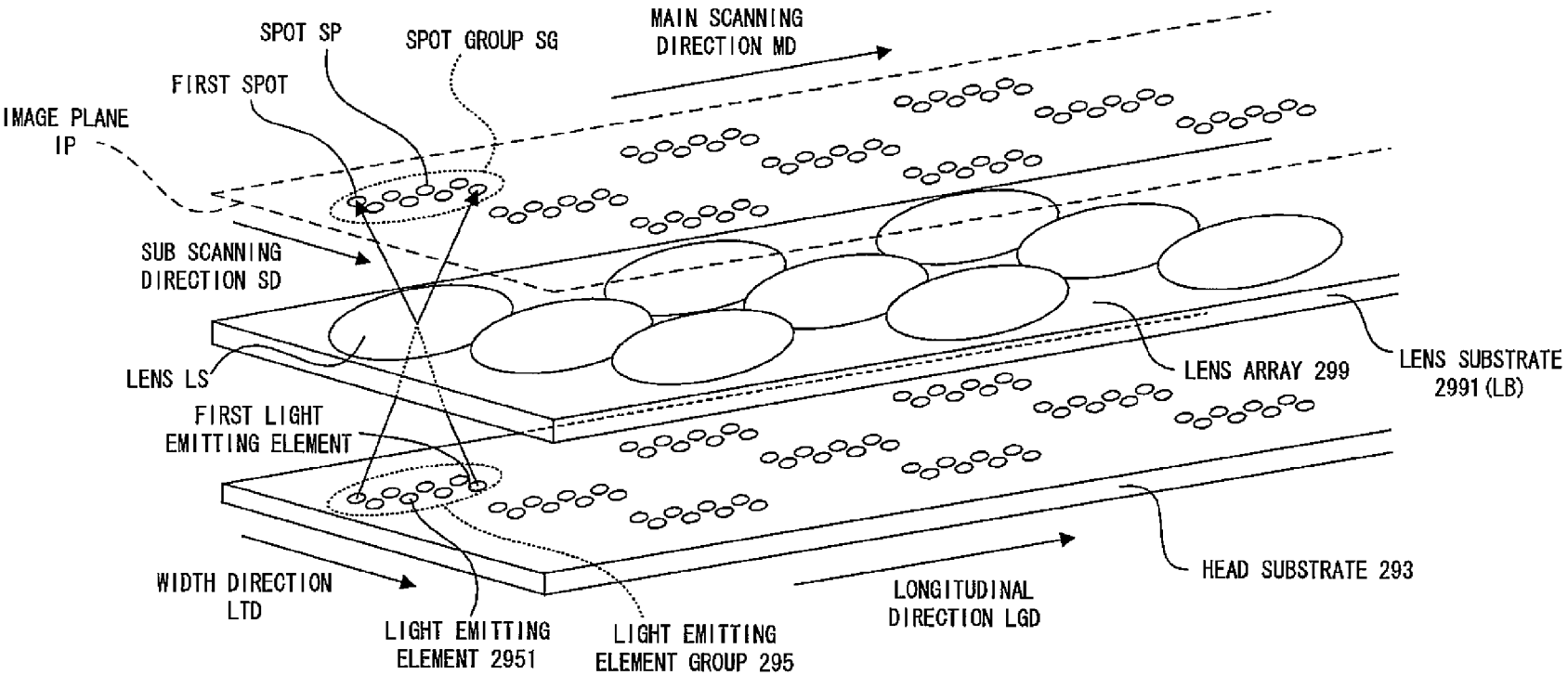
FIGS. 1 and 2 are diagrams showing terminology used in this specification.
Figure 2:
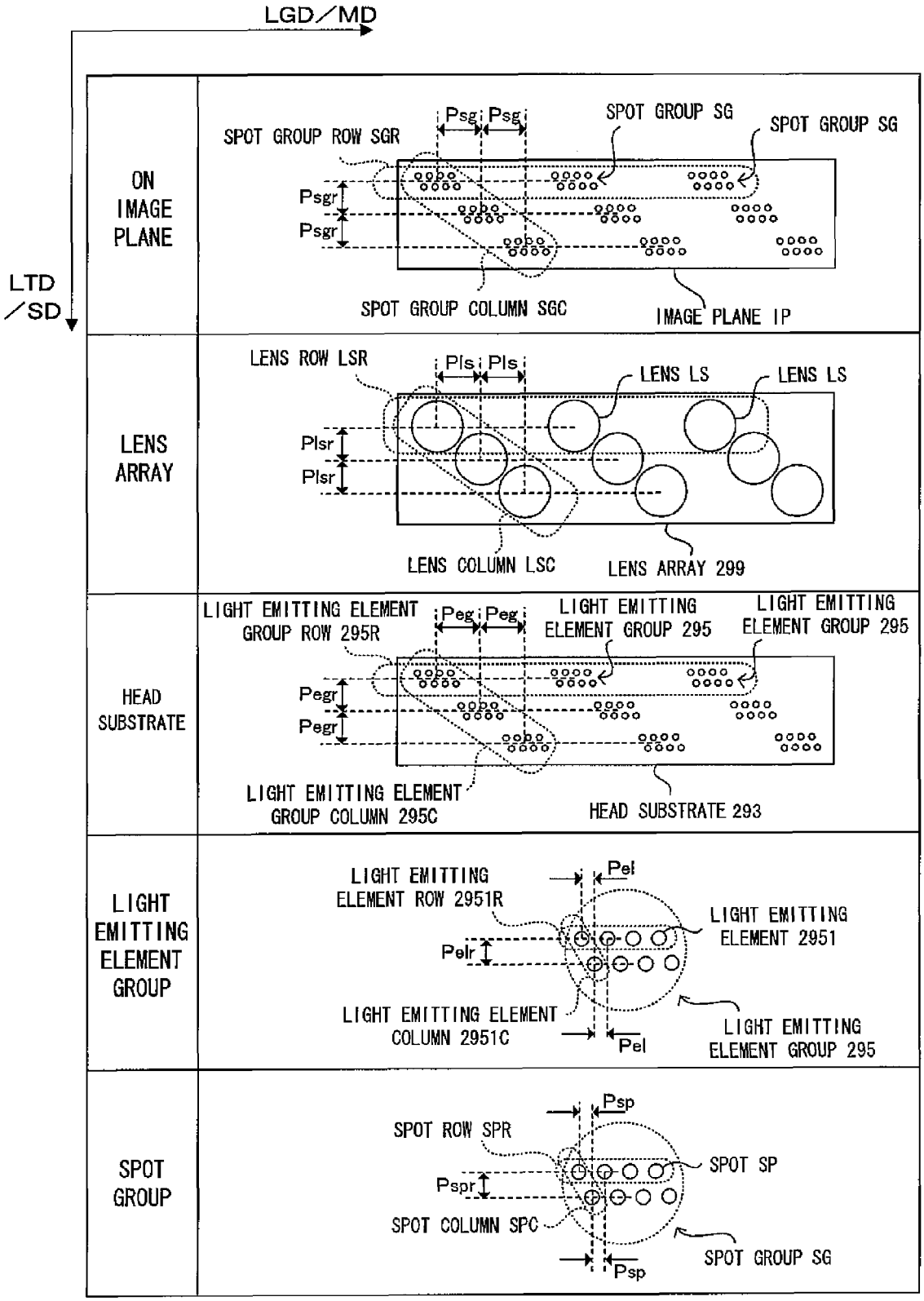

FIGS. 1 and 2 are diagrams showing terminology used in this specification. Here, terminology used in this specification is organized with reference to FIGS. 1 and 2. In this specification, a conveying direction of a surface (image plane IP) of a photosensitive drum 21 is defined to be a sub scanning direction SD and a direction orthogonal to or substantially orthogonal to the sub scanning direction SD is defined to be a main scanning direction MD. Further, a line head 29 is arranged relative to the surface (image plane IP) of the photosensitive drum 21 such that its longitudinal direction LGD corresponds to the main scanning direction MD and its width direction LTD corresponds to the sub scanning direction SD.

Collections of a plurality of (eight in FIGS. 1 and 2) light emitting elements 2951 arranged on a head substrate 293 in one-to-one correspondence with a plurality of lenses LS of a lens array 299 are defined to be light emitting element groups 295. In other words, in the head substrate 293, the plurality of light emitting element groups 295 including the plurality of light emitting elements 2951 are arranged in conformity with the plurality of lenses LS, respectively. Further, collections of a plurality of spots SP formed on the image plane IP by imaging light beams from the light emitting element groups 295 toward the image plane IP by the lenses LS corresponding to the light emitting element groups 295 are defined to be spot groups SG. In other words, a plurality of spot groups SG can be formed in one-to-one correspondence with the plurality of light emitting element groups 295. In each spot group SG, the most upstream spot in the main scanning direction MD and the sub scanning direction SD is particularly defined to be a first spot. The light emitting element 2951 corresponding to the first spot is particularly defined to be a first light emitting element.

A spot group row SGR and a spot group column SGC are defined as shown in the column "On Image Plane" of FIG. 2. Specifically, a plurality of spot groups SG arranged in the main scanning direction MD are defined as the spot group row SGR. A plurality of spot group rows SGR are arranged at specified spot group row pitches Psgr in the sub scanning direction SD. Further, a plurality of (three in FIG. 2) spot groups SG arranged at spot group row pitches Psgr in the sub scanning direction SD and at spot group pitches Psg in the main scanning direction MD are defined as the spot group column SGC. The spot group row pitch Psgr is a distance in the sub scanning direction SD between the geometric centers of gravity of two spot group rows SGR adjacent in the sub scanning direction SD, and the spot group pitch Psg is a distance in the main scanning direction MD between the geometric centers of gravity of two spot groups SG adjacent in the main scanning direction MD.

Lens rows LSR and lens columns LSC are defined as shown in the column of "Lens Array" of FIG. 2. Specifically, a plurality of lenses LS aligned in the longitudinal direction LGD is defined to be the lens row LSR. A plurality of lens rows LSR are arranged at specified lens row pitches Plsr in the width direction LTD. Further, a plurality of (three in FIG. 2) lenses LS arranged at the lens row pitches Plsr in the width direction LTD and at lens pitches Pls in the longitudinal direction LGD are defined to be the lens column LSC. It should be noted that the lens row pitch Plsr is a distance in the width direction LTD between the geometric centers of gravity of two lens rows LSR adjacent in the width direction LTD, and that the lens pitch Pls is a distance in the longitudinal direction LGD between the geometric centers of gravity of two lenses LS adjacent in the longitudinal direction LGD.

Light emitting element group rows 295R and light emitting element group columns 295C are defined as in the column "Head Substrate" of FIG. 2. Specifically, a plurality of light emitting element groups 295 aligned in the longitudinal direction LGD is defined to be the light emitting element group row 295R. A plurality of light emitting element group rows 295R are arranged at specified light emitting element group row pitches Pegr in the width direction LTD. Further, a plurality of (three in FIG. 2) light emitting element groups 295 arranged at the light emitting element group row pitches Pegr in the width direction LTD and at light emitting element group pitches Peg in the longitudinal direction LGD are defined to be the light emitting element group column 295C. It should be noted that the light emitting element group row pitch Pegr is a distance in the width direction LTD between the geometric centers of gravity of two light emitting element group rows 295R adjacent in the width direction LTD, and that the light emitting element group pitch Peg is a distance in the longitudinal direction LGD between the geometric centers of gravity of two light emitting element groups 295 adjacent in the longitudinal direction LGD.

Light emitting element rows 2951R and light emitting element columns 2951C are defined as in the column "Light Emitting Element Group" of FIG. 2. Specifically, in each light emitting element group 295, a plurality of light emitting elements 2951 aligned in the longitudinal direction LGD is defined to be the light emitting element row 2951R. A plurality of light emitting element rows 2951R are arranged at specified light emitting element row pitches Pelr in the width direction LTD. Further, a plurality of (two in FIG. 2) light emitting elements 2951 arranged at the light emitting element row pitches Pelr in the width direction LTD and at light emitting element pitches Pel in the longitudinal direction LGD are defined to be the light emitting element column 2951C. It should be noted that the light emitting element row pitch Pelr is a distance in the width direction LTD between the geometric centers of gravity of two light emitting element rows 2951R adjacent in the width direction LTD, and that the light emitting element pitch Pel is a distance in the longitudinal direction LGD between the geometric centers of gravity of two light emitting elements 2951 adjacent in the longitudinal direction LGD.

Spot rows SPR and spot columns SPC are defined as shown in the column "Spot Group" of FIG. 2. Specifically, in each spot group SG, a plurality of spots SP aligned in the longitudinal direction LGD is defined to be the spot row SPR. A plurality of spot rows SPR are arranged at specified spot row pitches Pspr in the width direction LTD. Further, a plurality of (two in FIG. 2) spots arranged at the spot row pitches Pspr in the width direction LTD and at spot pitches Psp in the longitudinal direction LGD are defined to be the spot column SPC. It should be noted that the spot row pitch Pspr is a distance in the sub scanning direction SD between the geometric centers of gravity of two spot rows SPR adjacent in the sub scanning direction SD, and that the spot pitch Psp is a distance in the main scanning direction MD between the geometric centers of gravity of two spots SP adjacent in the main scanning direction MD.

B. First Embodiment

Figure 3:
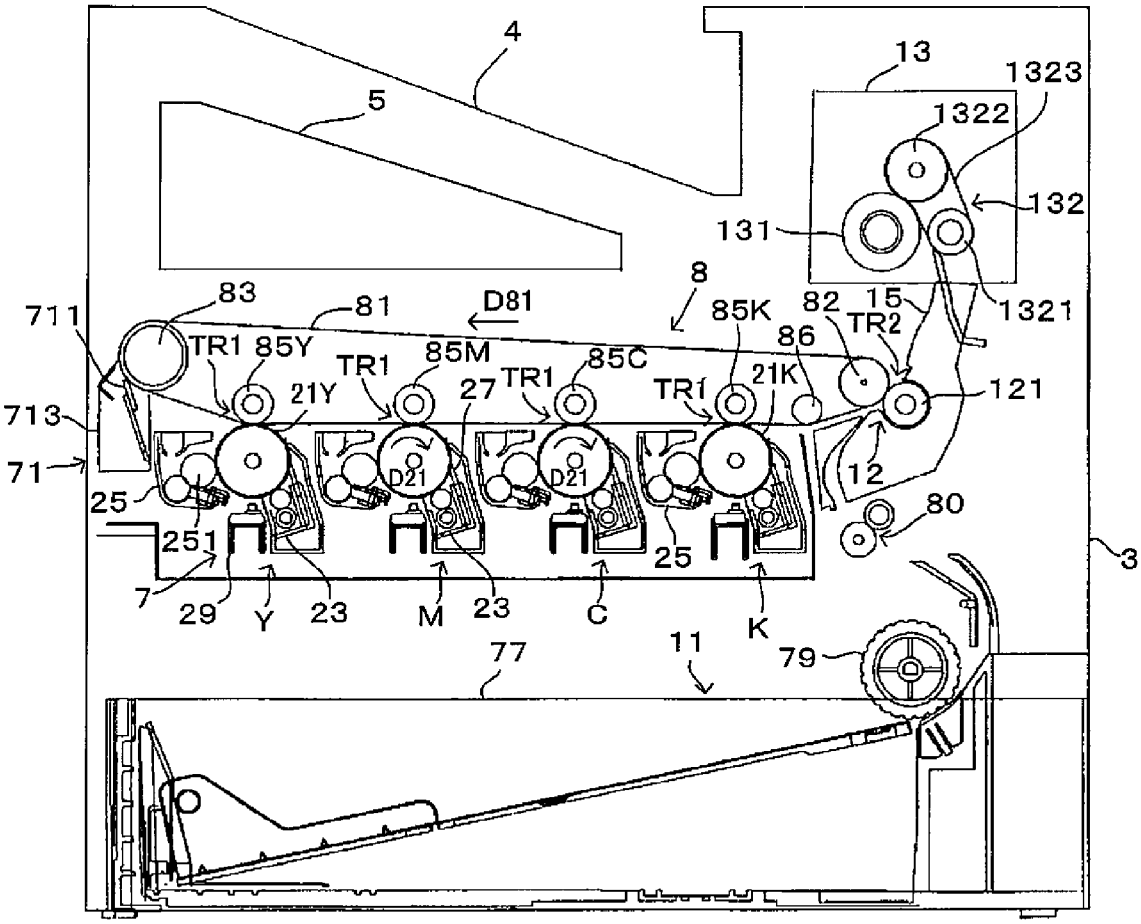
FIG. 3 is a diagram showing an embodiment of an image forming apparatus to which the invention is applicable.
Figure 4:
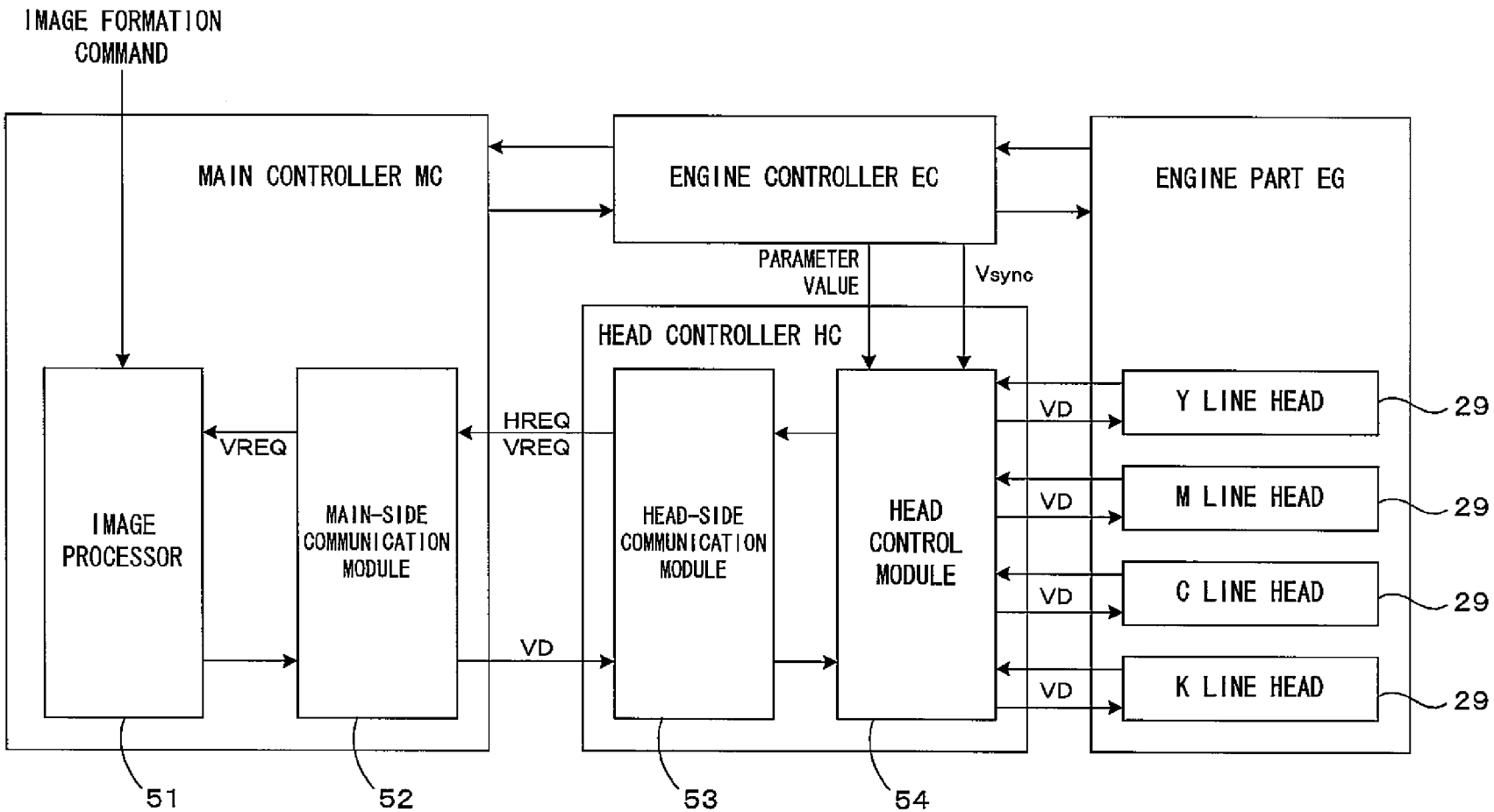
FIG. 4 is a diagram showing the electrical construction of the image forming apparatus of FIG. 3.

FIG. 3 is a diagram showing an embodiment of an image forming apparatus to which the invention is applicable. FIG. 4 is a diagram showing the electrical construction of the image forming apparatus of FIG. 3. This apparatus is an image forming apparatus that can selectively execute a color mode for forming a color image by superimposing four color toners of black (K), cyan (C), magenta (M) and yellow (Y) and a monochromatic mode for forming a monochromatic image using only black (K) toner. FIG. 3 is a diagram corresponding to the execution of the color mode. In this image forming apparatus, when an image formation command is given from an external apparatus such as a host computer to a main controller MC having a CPU and memories, the main controller MC feeds a control signal and the like to an engine controller EC and feeds video data VD corresponding to the image formation command to a head controller HC. This head controller HC controls line heads 29 of the respective colors based on the video data VD from the main controller MC, a vertical synchronization signal Vsync from the engine controller EC and parameter values from the engine controller EC. In this way, an engine part EG performs a specified image forming operation to form an image corresponding to the image formation command on a sheet such as a copy sheet, transfer sheet, form sheet or transparent sheet for OHP.

An electrical component box 5 having a power supply circuit board, the main controller MC, the engine controller EC and the head controller HC built therein is disposed in a housing main body 3 of the image forming apparatus. An image forming unit 7, a transfer belt unit 8 and a sheet feeding unit 11 are also arranged in the housing main body 3. A secondary transfer unit 12, a fixing unit 13 and a sheet guiding member 15 are arranged at the right side in the housing main body 3 in FIG. 3. It should be noted that the sheet feeding unit 11 is detachably mountable into the housing main body 3. The sheet feeding unit 11 and the transfer belt unit 8 are so constructed as to be detachable for repair or exchange respectively.

The image forming unit 7 includes four image forming stations Y (for yellow), M (for magenta), C (for cyan) and K (for black) which form a plurality of images having different colors. Each of the image forming stations Y, M, C and K includes a cylindrical photosensitive drum 21 having a surface of a specified length in a main scanning direction MD. Each of the image forming stations Y, M, C and K forms a toner image of the corresponding color on the surface of the photosensitive drum 21. The photosensitive drum is arranged so that the axial direction thereof is substantially parallel to the main scanning direction MD. Each photosensitive drum 21 is connected to its own driving motor and is driven to rotate at a specified speed in a direction of arrow D21 in FIG. 3, whereby the surface of the photosensitive drum 21 is transported in the sub scanning direction SD which is orthogonal to or substantially orthogonal to the main scanning direction MD. Further, a charger 23, the line head 29, a developer 25 and a photosensitive drum cleaner 27 are arranged in a rotating direction around each photosensitive drum 21. A charging operation, a latent image forming operation and a toner developing operation are performed by these functional sections. Accordingly, a color image is formed by superimposing toner images formed by all the image forming stations Y, M, C and K on a transfer belt 81 of the transfer belt unit 8 at the time of executing the color mode, and a monochromatic image is formed using only a toner image formed by the image forming station K at the time of executing the monochromatic mode. Meanwhile, since the respective image forming stations of the image forming unit 7 are identically constructed, reference characters are given to only some of the image forming stations while being not given to the other image forming stations in order to facilitate the diagrammatic representation in FIG. 3.

The charger 23 includes a charging roller having the surface thereof made of an elastic rubber. This charging roller is constructed to be rotated by being held in contact with the surface of the photosensitive drum 21 at a charging position. As the photosensitive drum 21 rotates, the charging roller is rotated at the same circumferential speed in a direction driven by the photosensitive drum 21. This charging roller is connected to a charging bias generator (not shown) and charges the surface of the photosensitive drum 21 at the charging position where the charger 23 and the photosensitive drum 21 are in contact upon receiving the supply of a charging bias from the charging bias generator.

The line head 29 is arranged relative to the photosensitive drum 21 so that the longitudinal direction thereof corresponds to the main scanning direction MD and the width direction thereof corresponds to the sub scanning direction SD. Hence, the longitudinal direction of the line head 29 is substantially parallel to the main scanning direction MD. The line head 29 includes a plurality of light emitting elements arrayed in the longitudinal direction and is positioned separated from the photosensitive drum 21. Light beams are emitted from these light emitting elements toward the surface of the photosensitive drum 21 charged by the charger 23, thereby forming an electrostatic latent image on this surface.

The developer 25 includes a developing roller 251 carrying toner on the surface thereof. By a development bias applied to the developing roller 251 from a development bias generator (not shown) electrically connected to the developing roller 251, charged toner is transferred from the developing roller 251 to the photosensitive drum 21 to develop the latent image formed by the line head 29 at a development position where the developing roller 251 and the photosensitive drum 21 are in contact.

The toner image developed at the development position in this way is primarily transferred to the transfer belt 81 at a primary transfer position TR1 to be described later where the transfer belt 81 and each photosensitive drum 21 are in contact after being transported in the rotating direction D21 of the photosensitive drum 21.

Further, the photosensitive drum cleaner 27 is disposed in contact with the surface of the photosensitive drum 21 downstream of the primary transfer position TR1 and upstream of the charger 23 with respect to the rotating direction D21 of the photosensitive drum 21. This photosensitive drum cleaner 27 removes the toner remaining on the surface of the photosensitive drum 21 to clean after the primary transfer by being held in contact with the surface of the photosensitive drum.

The transfer belt unit 8 includes a driving roller 82, a driven roller (blade facing roller) 83 arranged to the left of the driving roller 82 in FIG. 3, and the transfer belt 81 mounted on these rollers. The transfer belt unit 8 also includes four primary transfer rollers 85Y, 85M, 85C and 85K arranged to face in a one-to-one relationship with the photosensitive drums 21 of the respective image forming stations Y, M, C and K inside the transfer belt 81 when the photosensitive cartridges are mounted. These primary transfer rollers 85Y, 85M, 85C and 85K are respectively electrically connected to a primary transfer bias generator (not shown). As described in detail later, at the time of executing the color mode, all the primary transfer rollers 85Y, 85M, 85C and 85K are positioned on the sides of the image forming stations Y, M, C and K as shown in FIG. 3, whereby the transfer belt 81 is pressed into contact with the photosensitive drums 21 of the image forming stations Y, M, C and K to form the primary transfer positions TR1 between the respective photosensitive drums 21 and the transfer belt 81. By applying primary transfer biases from the primary transfer bias generator to the primary transfer rollers 85Y, 85M, 85C and 85K at suitable timings, the toner images formed on the surfaces of the respective photosensitive drums 21 are transferred to the surface of the transfer belt 81 at the corresponding primary transfer positions TR1 to form a color image.

On the other hand, out of the four primary transfer rollers 85Y, 85M, 85C and 85K, the color primary transfer rollers 85Y, 85M, 85C are separated from the facing image forming stations Y, M and C and only the monochromatic primary transfer roller 85K is brought into contact with the image forming station K at the time of executing the monochromatic mode, whereby only the monochromatic image forming station K is brought into contact with the transfer belt 81. As a result, the primary transfer position TR1 is formed only between the monochromatic primary transfer roller 85K and the image forming station K. By applying a primary transfer bias at a suitable timing from the primary transfer bias generator to the monochromatic primary transfer roller 85K, the toner image formed on the surface of the photosensitive drum 21 is transferred to the surface of the transfer belt 81 at the primary transfer position TR1 to form a monochromatic image.

The transfer belt unit 8 further includes a downstream guide roller 86 disposed downstream of the monochromatic primary transfer roller 85K and upstream of the driving roller 82. This downstream guide roller 86 is so disposed as to come into contact with the transfer belt 81 on an internal common tangent to the primary transfer roller 85K and the photosensitive drum 21 at the primary transfer position TR1 formed by the contact of the monochromatic primary transfer roller 85K with the photosensitive drum 21 of the image forming station K.

The driving roller 82 drives to rotate the transfer belt 81 in the direction of the arrow D81 and doubles as a backup roller for a secondary transfer roller 121. A rubber layer having a thickness of about 3 mm and a volume resistivity of 1000 kΩ·cm or lower is formed on the circumferential surface of the driving roller 82 and is grounded via a metal shaft, thereby serving as an electrical conductive path for a secondary transfer bias to be supplied from an unillustrated secondary transfer bias generator via the secondary transfer roller 121. By providing the driving roller 82 with the rubber layer having high friction and shock absorption, an impact caused upon the entrance of a sheet into a contact part (secondary transfer position TR2) of the driving roller 82 and the secondary transfer roller 121 is unlikely to be transmitted to the transfer belt 81 and image deterioration can be prevented.

The sheet feeding unit 11 includes a sheet feeding section which has a sheet cassette 77 capable of holding a stack of sheets, and a pickup roller 79 which feeds the sheets one by one from the sheet cassette 77. The sheet fed from the sheet feeding section by the pickup roller 79 is fed to the secondary transfer position TR2 along the sheet guiding member 15 after having a sheet feed timing adjusted by a pair of registration rollers 80.

The secondary transfer roller 121 is provided freely to abut on and move away from the transfer belt 81, and is driven to abut on and move away from the transfer belt 81 by a secondary transfer roller driving mechanism (not shown). The fixing unit 13 includes a heating roller 131 which is freely rotatable and has a heating element such as a halogen heater built therein, and a pressing section 132 which presses this heating roller 131. The sheet having an image secondarily transferred to the front side thereof is guided by the sheet guiding member 15 to a nip portion formed between the heating roller 131 and a pressure belt 1323 of the pressing section 132, and the image is thermally fixed at a specified temperature in this nip portion. The pressing section 132 includes two rollers 1321 and 1322 and the pressure belt 1323 mounted on these rollers. Out of the surface of the pressure belt 1323, a part stretched by the two rollers 1321 and 1322 is pressed against the circumferential surface of the heating roller 131, thereby forming a sufficiently wide nip portion between the heating roller 131 and the pressure belt 1323. The sheet having been subjected to the image fixing operation in this way is transported to the discharge tray 4 provided on the upper surface of the housing main body 3.

Further, a cleaner 71 is disposed facing the blade facing roller 83 in this apparatus. The cleaner 71 includes a cleaner blade 711 and a waste toner box 713. The cleaner blade 711 removes foreign matters such as toner remaining on the transfer belt after the secondary transfer and paper powder by holding the leading end thereof in contact with the blade facing roller 83 via the transfer belt 81. Foreign matters thus removed are collected into the waste toner box 713. Further, the cleaner blade 711 and the waste toner box 713 are constructed integral to the blade facing roller 83. Accordingly, if the blade facing roller 83 moves as described next, the cleaner blade 711 and the waste toner box 713 move together with the blade facing roller 83.

Figure 5:
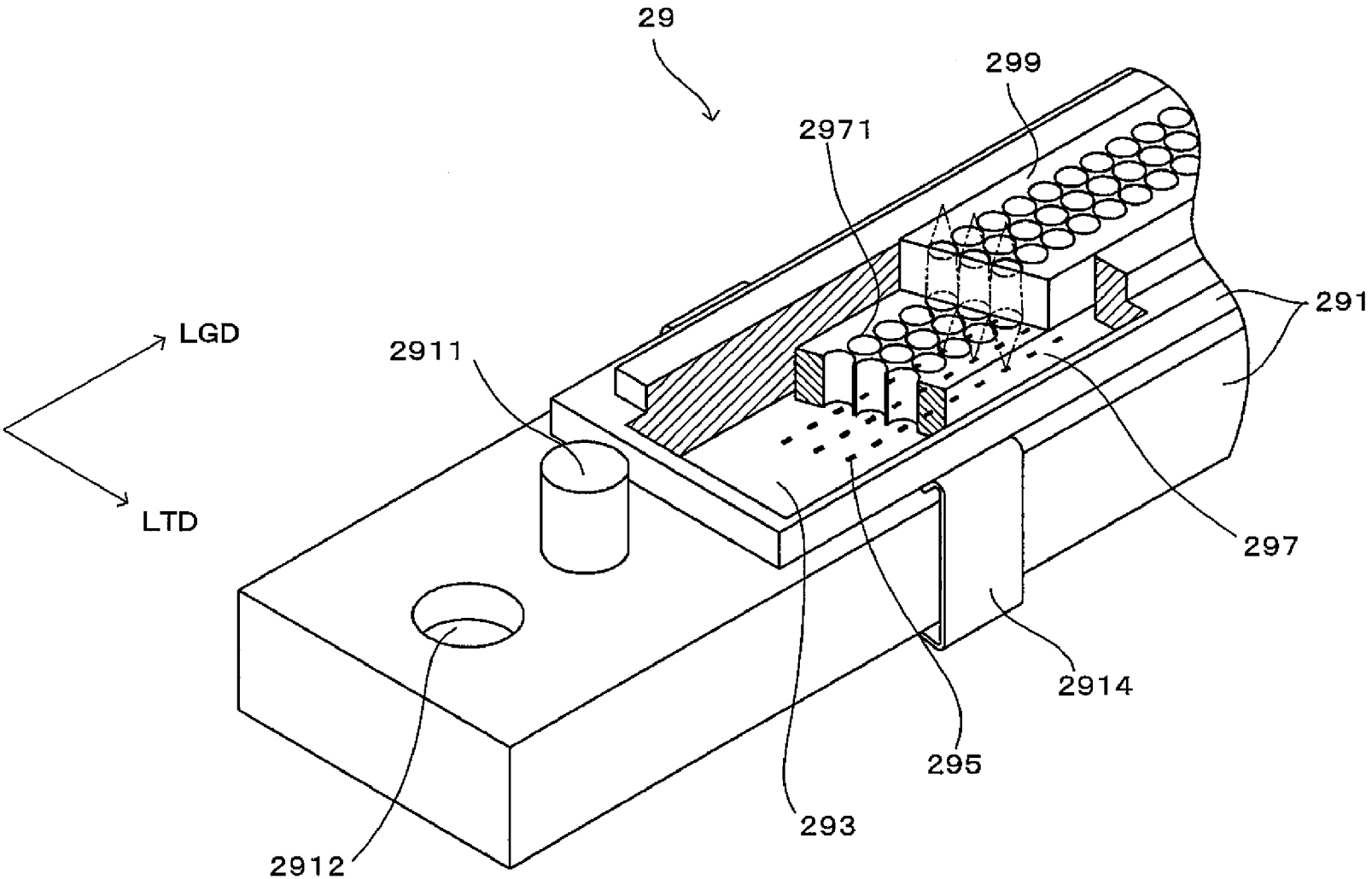
FIG. 5 is a perspective view schematically showing a line head.
Figure 6:
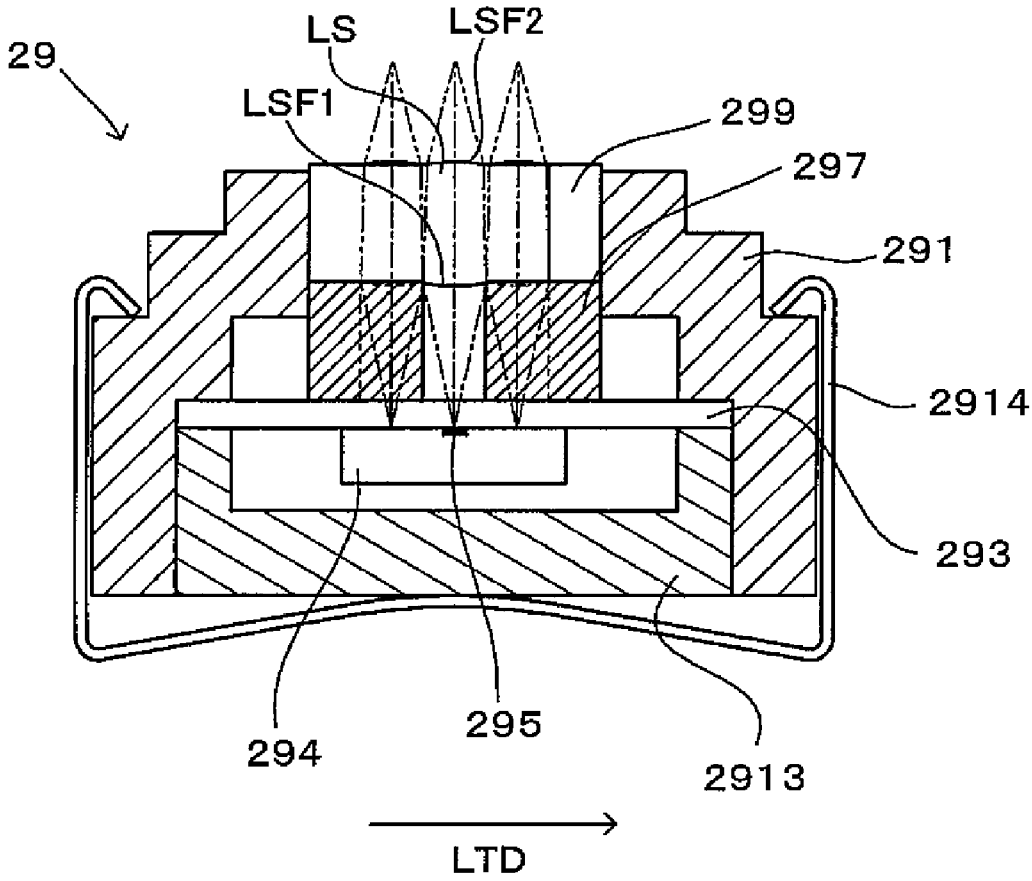
FIG. 6 is a sectional view along a width direction of the line head shown in FIG. 5.

FIG. 5 is a perspective view schematically showing a line head, and FIG. 6 is a sectional view along a width direction of the line head shown in FIG. 5. As described above, the line head 29 is arranged to face the photosensitive drum 21 such that the longitudinal direction LGD corresponds to the main scanning direction MD and the width direction LTD corresponds to the sub scanning direction SD. The longitudinal direction LGD and the width direction LTD are substantially normal to each other. The line head 29 is positioned relative to the photosensitive drum 21 by fitting such positioning pins 2911 into positioning holes (not shown) perforated in a photosensitive drum cover (not shown) covering the photosensitive drum 21 and positioned relative to the photosensitive drum 21. Further, the line head 29 is positioned and fixed relative to the photosensitive drum 21 by screwing fixing screws into screw holes (not shown) of the photosensitive drum cover via the screw insertion holes 2912 to be fixed.

The case 291 carries a lens array 299 at a position facing the surface of the photosensitive drum 21, and includes a light shielding member 297 and a head substrate 293 inside, the light shielding member 297 being closer to the lens array 299 than the head substrate 293. The head substrate 293 is made of a transmissive material (glass for instance). Further, a plurality of bottom emission-type EL (electroluminescence) devices are provided on an under surface of the head substrate 293 (surface opposite to the lens array 299 out of two surfaces of the head substrate 293) as the plurality of light emitting elements 2951. The plurality of light emitting elements 2951 are arranged as groups for each light emitting element group 295 as described later. The light beams emitted from the respective light emitting element groups 295 propagate toward the light shielding member 297 after passing through the head substrate 293 from the under surface thereof to a top surface thereof.

The light shielding member 297 is perforated with a plurality of light guide holes 2971 in a one-to-one correspondence with the plurality of light emitting element groups 295. The light guide holes 2971 are substantially cylindrical holes penetrating the light shielding member 297 and having central axes in parallel with normals to the head substrate 293. Accordingly, out of light beams emitted from the light emitting element groups 295, those propagating toward other than the light guide holes 2971 corresponding to the light emitting element groups 295 are shielded by the light shielding member 297. In this way, all the lights emitted from one light emitting element group 295 propagate toward the lens array 299 via the same light guide hole 2971 and the mutual interference of the light beams emitted from different light emitting element groups 295 can be prevented by the light shielding member 297. The light beams having passed through the light guide holes 2971 perforated in the light shielding member 297 are imaged as spots on the surface of the photosensitive drum 21 by the lens array 299.

As shown in FIG. 6, an underside lid 2913 is pressed against the case 291 via the head substrate 293 by retainers 2914. Specifically, the retainers 2914 have elastic forces to press the underside lid 2913 toward the case 291, and seal the inside of the case 291 light-tight (that is, so that light does not leak from the inside of the case 291 and so that light does not intrude into the case 291 from the outside) by pressing the underside lid by means of the elastic force. It should be noted that a plurality of the retainers 2914 are provided at a plurality of positions in the longitudinal direction of the case 291. The light emitting element groups 295 are covered with a sealing member 294.

Figure 7:
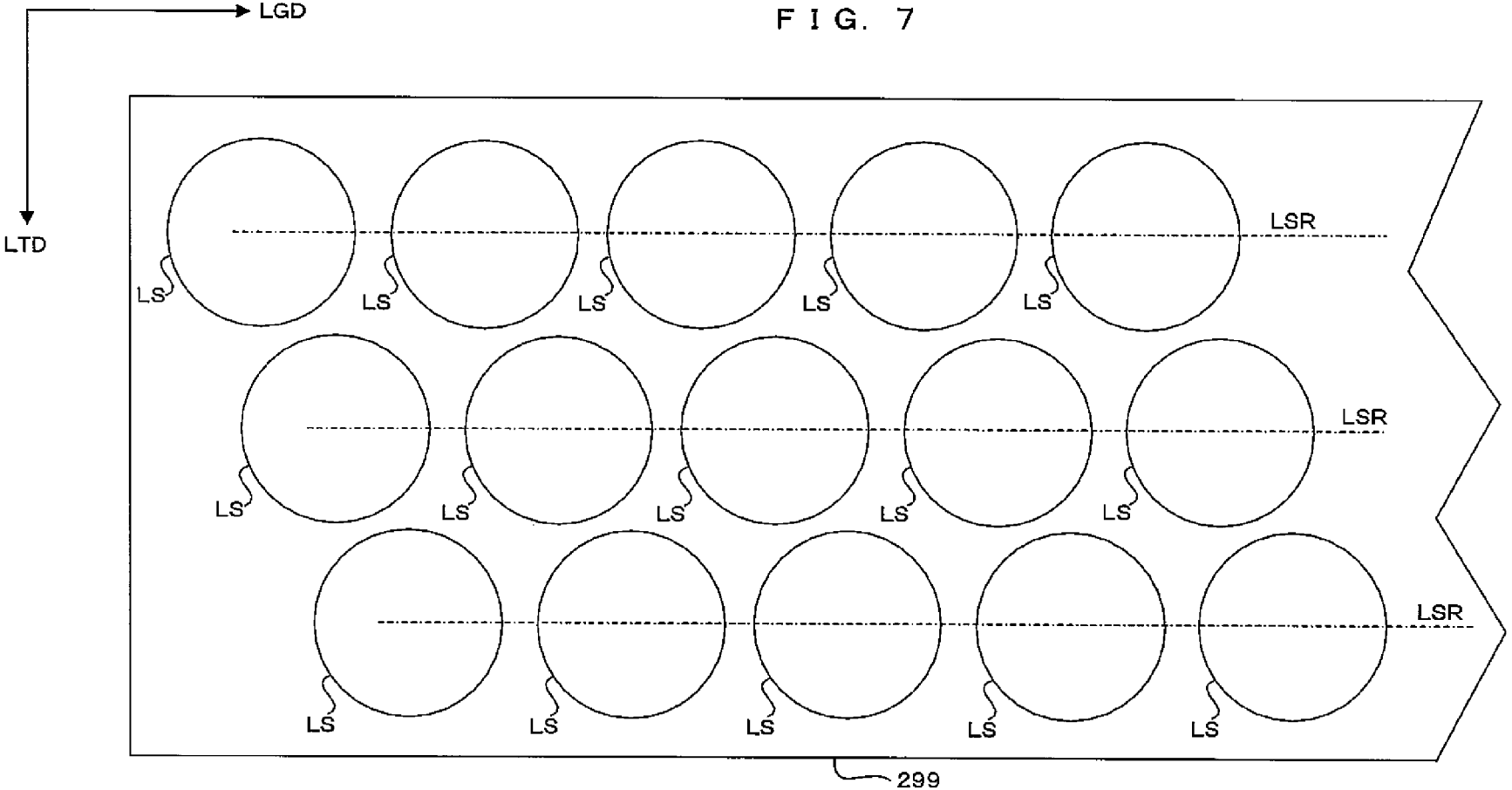
FIG. 7 is a plan view schematically showing the lens array.

FIG. 7 is a plan view schematically showing the lens array and corresponds to a case where the lens array is seen from an image plane side (that is, from the surface of the photosensitive drum 21). As shown in FIG. 7, in this lens array 299, a plurality of lenses LS are aligned in the longitudinal direction LGD to form a lens row LSR, and three lens rows are arranged in the width direction LTD. These three lens rows LSR1 to LSR3 are displaced from each other in the longitudinal direction LGD so that the positions of the respective lenses LS mutually differ in the longitudinal direction LGD. As a result, the positions of the respective lenses LS mutually differ in the longitudinal direction LGD.

Figure 8:
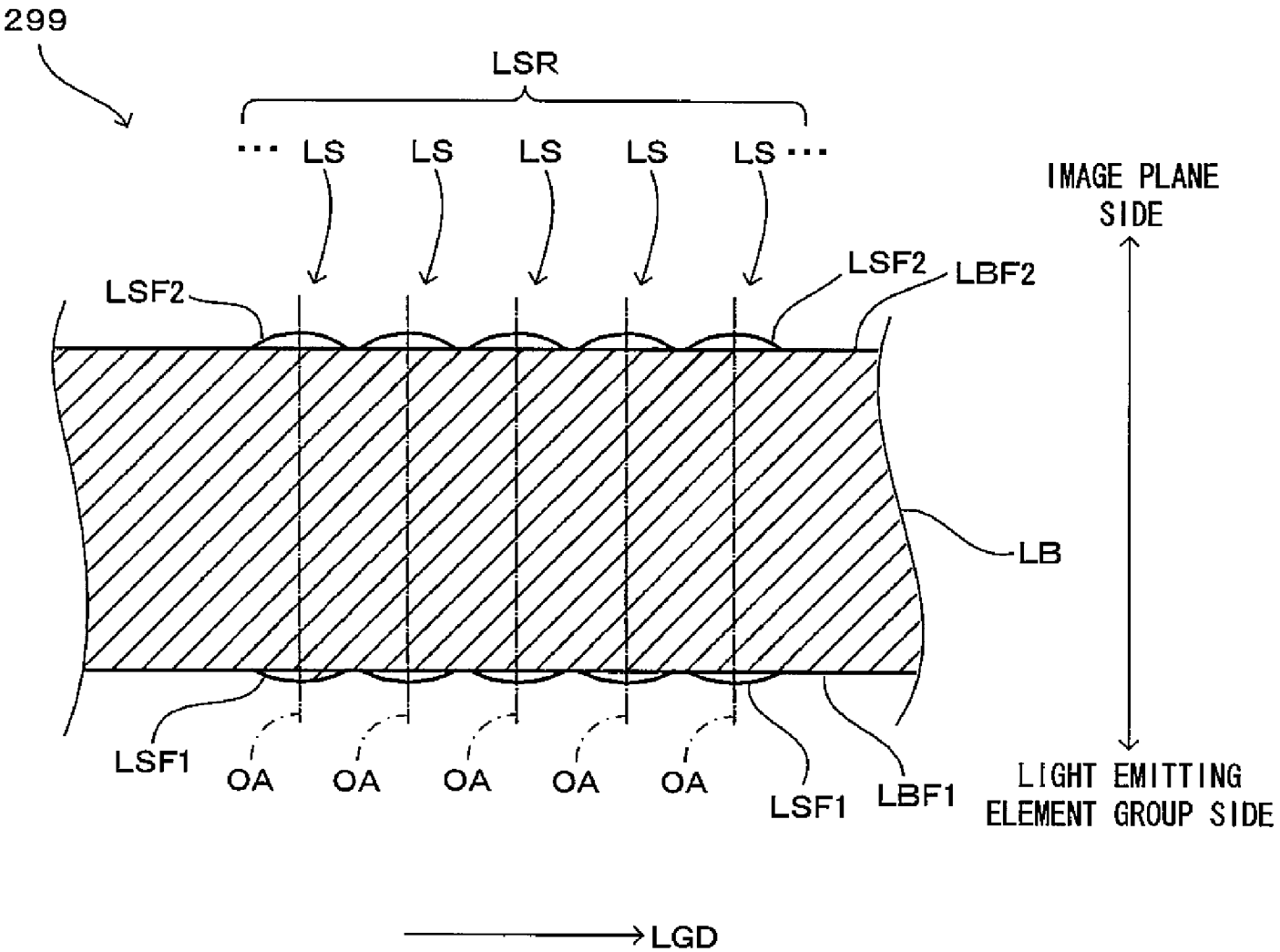
FIG. 8 is a sectional view of the lens array in the longitudinal direction.

FIG. 8 is a sectional view of the lens array in the longitudinal direction and corresponds to a case where the lens array is seen in a cross section including optical axes OA of the respective lenses. In FIG. 8, an upper side is the image plane side and a lower side is a light emitting element group side. The lens array 299 includes one lens substrate LB made of glass, and the lens LS is formed by arranging two lens surfaces LSF1, LSF2 facing in a direction of the optical axis OA with the lens substrate LB therebetween. These lens surfaces LSF1, LSF2 can be, for example, made of light curing resin. Out of the two lens surfaces, the lens surface LSF1 is formed on an under surface LBF1 of the lens substrate LB and the lens surface LSF2 is formed on a top surface LBF2 of the lens substrate LB. The above lens row LSR is formed by arranging these lenses LS in the longitudinal direction LGD.

Figure 9:
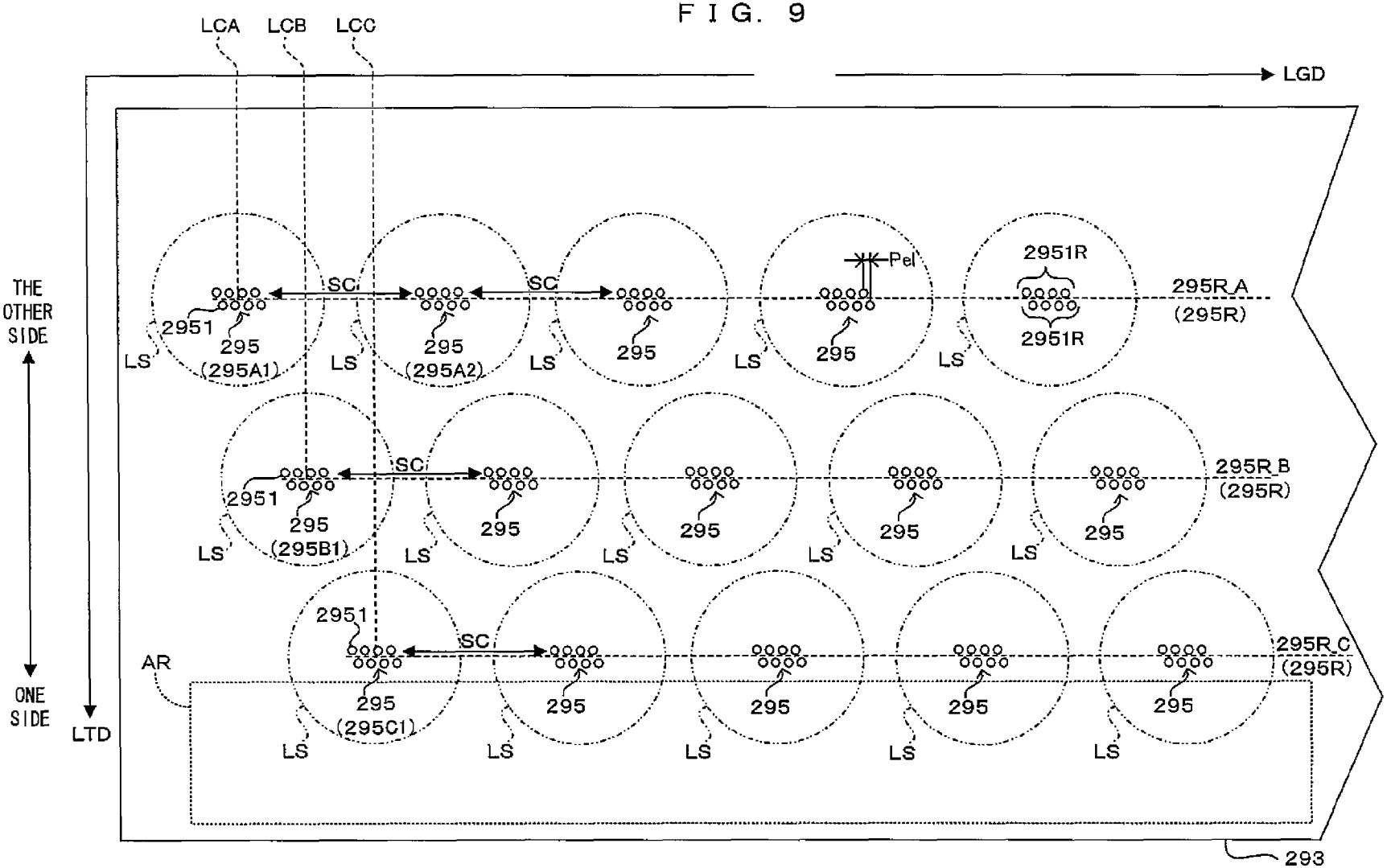
FIG. 9 is a diagram showing the configuration of the under surface of the head substrate.

FIG. 9 is a diagram showing the configuration of the under surface of the head substrate and corresponds to a case where the under surface of the head substrate is seen from the top surface. Although the lenses LS are shown by chain double-dashed line in FIG. 9, this is to show that the light emitting element groups 295 are provided in a one-to-one correspondence with the lenses LS, but not to show that the lenses LS are arranged on the under surface of the head substrate. As shown in FIG. 9, three light emitting element group rows 295R (295R_A, 295R_B, 295R_C) each including a plurality of light emitting element groups 295 aligned in the longitudinal direction LGD are arranged in the width direction LTD. In each of the light emitting element group rows 295R_A to 295R_C, a plurality of light emitting element groups 295 are aligned with adjacent light emitting element groups 295 spaced apart by a space SC. The respective light emitting element group rows 295R are displaced from each other in the longitudinal direction LGD so that the positions of the respective light emitting element groups 295 mutually differ in the longitudinal direction LGD. More specifically, positions LCA, LCB and LCC of the light emitting element groups 295A1, 295B1 and 295C1 in the longitudinal direction LGD mutually differ. In FIG. 9, the positions LCA, LCB and LCC are indicated by feet of perpendiculars to an axis of the longitudinal direction LGD from the center of gravity positions of the respective light emitting element groups 295A1, 295B1 and 295C1.

Since the respective light emitting element group rows 295R are displaced in the longitudinal direction LGD in this way, each light emitting element group 295 faces the spaces SC of the light emitting element group rows 295R, to which this light emitting element group 295 does not belongs, in the width direction LTD. Specifically, the light emitting element group 295A2, for example, faces the spaces SC of the light emitting element group rows 295R_B, 295R_C in the width direction LTD.

For later description, an area located more toward one side in the width direction LTD than the plurality of light emitting element groups 295 thus arranged is called a one side area AR. This one side area AR is an area on the under surface of the head substrate 293, that is, on the surface where the light emitting elements 2951 are formed.

In each light emitting element group 295, light emitting element rows 2951R each including four light emitting elements 2951 aligned in the longitudinal direction LGD are arranged in the width direction LTD. These light emitting element rows 2951R are displaced by a light emitting element pitch Pel in the longitudinal direction LGD so that the positions of the respective light emitting elements 2951 mutually differ in the longitudinal direction LGD. In this way, two light emitting element rows 2951R are arranged in an offset manner in the light emitting element group 295.

Figure 10:
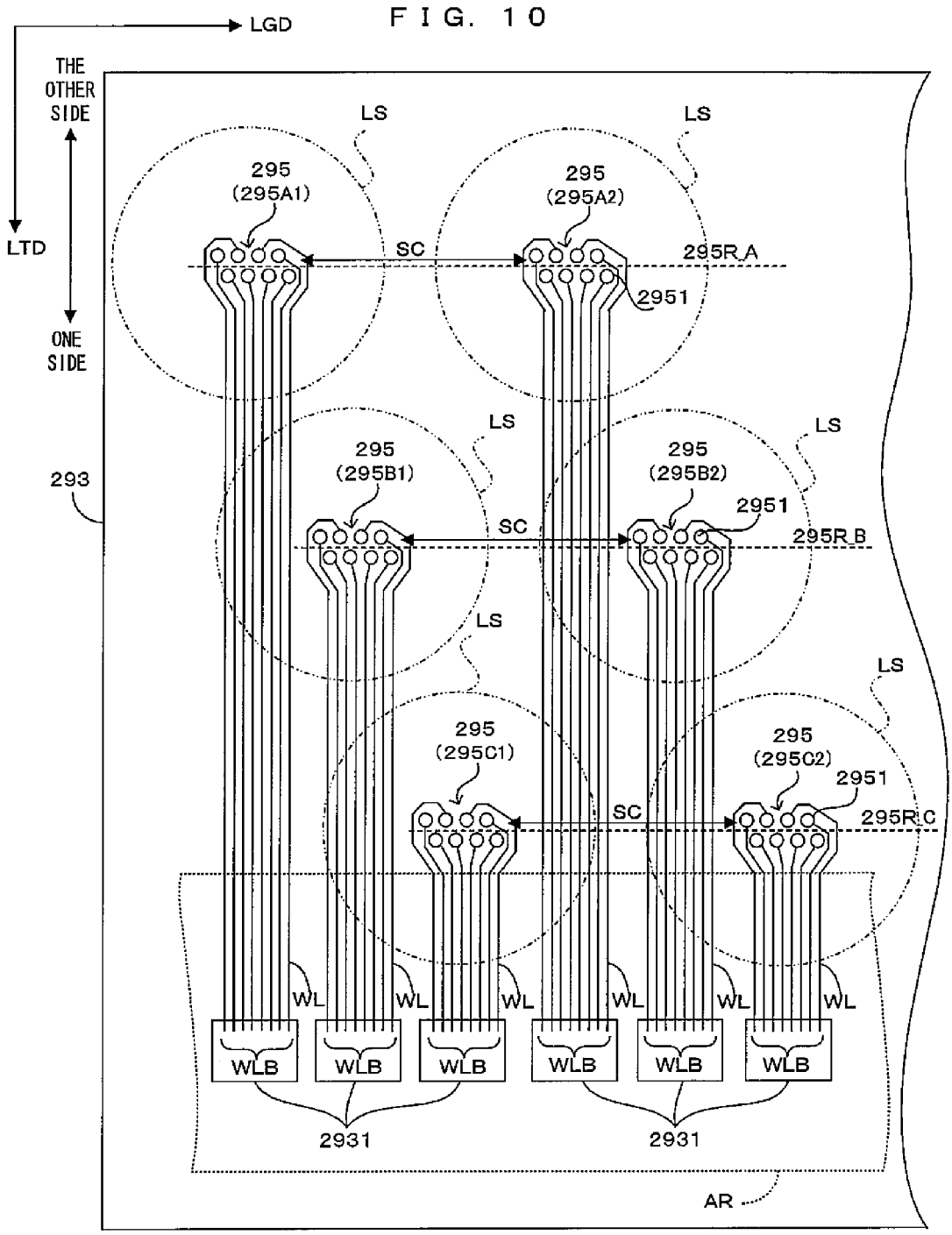
FIG. 10 is a plan view showing a connection mode of wirings with the light emitting element groups according to a first embodiment.

FIG. 10 is a plan view showing a connection mode of wirings with the light emitting element groups according to a first embodiment. As shown in FIG. 10, wirings WL are respectively connected with the plurality of light emitting elements 2951 of each light emitting element group 295. A plurality of wirings WL connected with the light emitting element group 295 in this way are bundled into a wiring bundle WLB, which is drawn to the outside of the lens LS. In the first embodiment, any of the wirings WL (or wiring bundles WLB) drawn from the respective light emitting element groups 295 is drawn to the one side area AR of the head substrate 293. At this time, the wirings WL drawn from one light emitting element group row 295R to the one side area AR via the other light emitting element group row(s) 295R pass the spaces SC of the other light emitting element group row(s) 295R. In other words, the wirings WL drawn from the light emitting element group row 295R_B are drawn to the one side area AR through the spaces SC of the light emitting element group row 295R_C. Further, the wirings WL drawn from the light emitting element group row 295R_A are drawn to the one side area AR first through the spaces SC of the light emitting element group row 295R_B and then through the spaces SC of the light emitting element group row 295R_C.

In other words, connecting portions 2931 are provided in the one side area AR. Specifically, the connecting portions 2931 are arranged at one side of the light emitting element groups 295B1, 295B2 opposite to the light emitting element group 295A2 in the width direction LTD. The wirings WL connected with the light emitting elements 2951 of the light emitting element group 295A2 are electrically connected with the connecting portion 2931 while passing between the light emitting element groups 295B1 and 295B2. Further, the connecting portions 2931 are arranged at one side of the light emitting element groups 295C1, 295C2 opposite to the light emitting element group 295B2 in the width direction LTD. The wirings WL connected with the light emitting elements 2951 of the light emitting element group 295B2 are electrically connected with the connecting portion 2931 while passing between the light emitting element groups 295C1 and 295C2.

Figure 11:
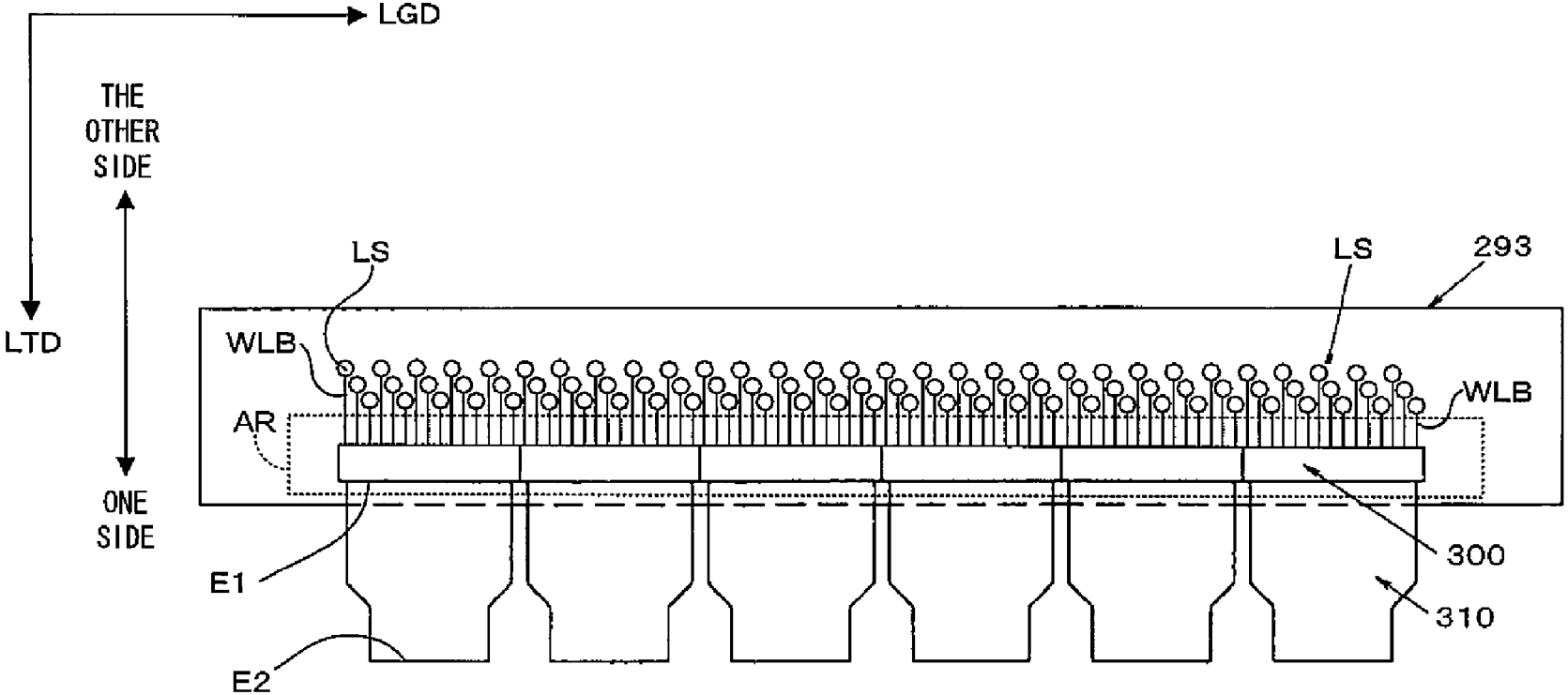
FIG. 11 is a diagram showing an arrangement relationship of the wiring bundles and driver ICs in the first embodiment.

FIG. 11 is a diagram showing an arrangement relationship of the wiring bundles and driver ICs in the first embodiment. In FIG. 11, only the wiring bundles WLB drawn to the outside of the lenses LS are shown, and the details of the wirings WL connected with the respective light emitting elements 2951 of the light emitting element groups 295 are not shown because they are as shown in FIG. 10. As shown in FIG. 11, a plurality of driver ICs (electric circuit) 300 are arranged in the longitudinal direction LGD in the one side area AR of the head substrate 293. These driver ICs 300 can be mounted on the head substrate 293, which is a glass substrate, by so-called chip on glass technology. As described above, the wiring bundles WLB drawn to the one side area AR are connected with the respective driver ICs 300. In other words, the respective driver ICs 300 are electrically connected with the connecting portions 2931 (FIG. 10) provided in the one side area AR and are electrically connected with the wiring bundles WLB via the connecting portions 2931. One end E1 of each FPC 310 is mounted in the one side area AR of the head substrate 293 and is connected with the corresponding driver IC 300. Other ends E2 of the FPCs 310 are drawn to the outside of the head substrate 293 and are so constructed that the video data VD outputted from the head controller HC can be inputted thereto. Accordingly, when the head controller HC outputs the video data VD at a suitable timing (FIG. 4), this video data VD is inputted to the other ends E2 of the FPCs 310. The video data VD inputted to the other ends E2 of the FPCs 310 in this way is inputted to the driver ICs 300 connected with the one ends E1 of the FPCs 310. In the driver ICs 300, this video data VD is converted into drive signals for driving the light emitting elements 2951. These drive signals are fed to the respective light emitting elements 2951 via the wirings WL. The respective light emitting elements 2951 to which the drive signals are given emit light beams of the same wavelength. The light emitting surfaces of the light emitting elements 2951 are so-called perfectly diffusing surface illuminants and the light beams emitted from the light emitting surfaces comply with Lambert's cosine law.

Figure 12:
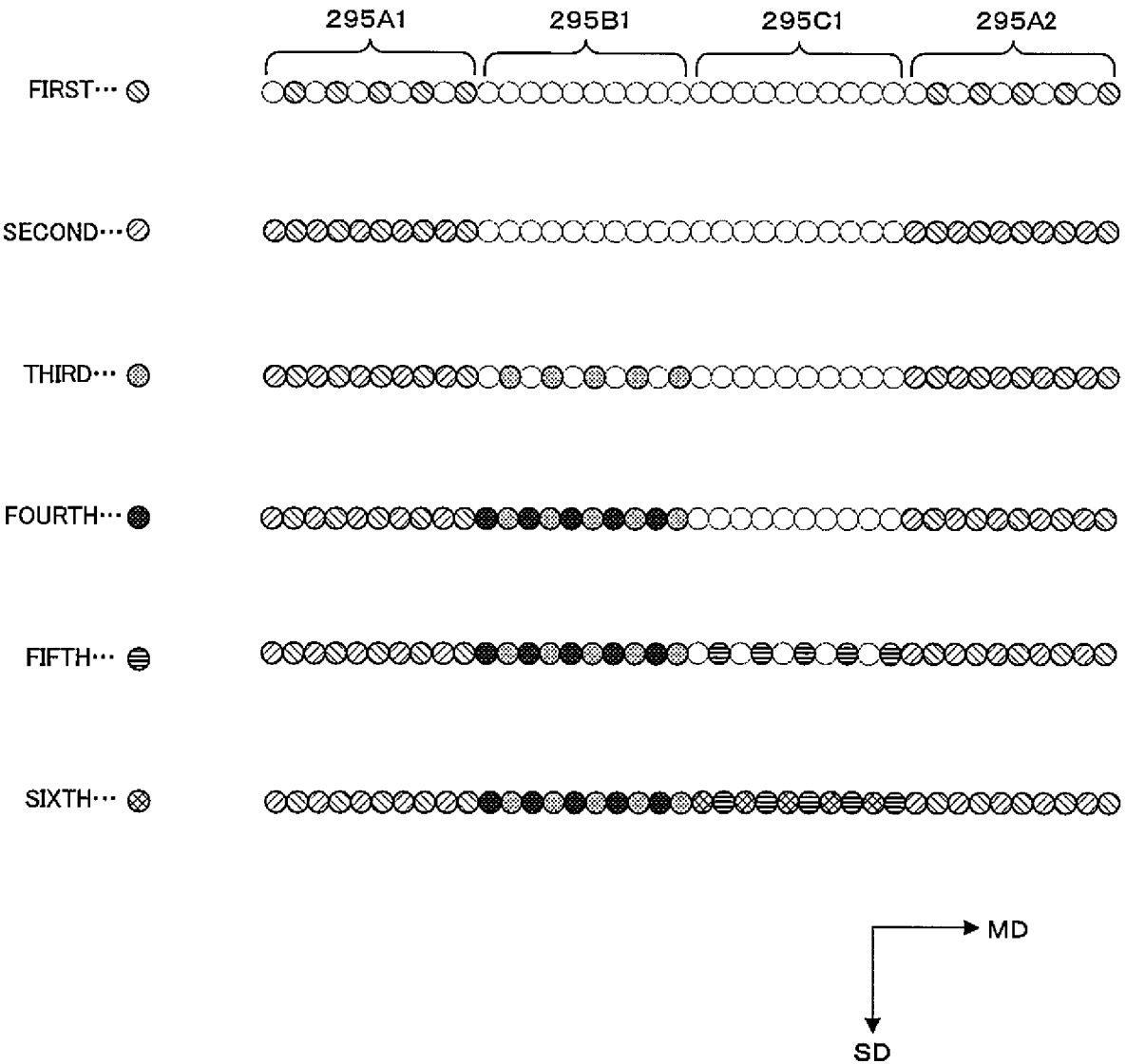
FIG. 12 is a diagram showing a spot forming operation by the above line head.

FIG. 12 is a diagram showing a spot forming operation by the above line head. The spot forming operation by the line head according to this embodiment is described below with reference to FIGS. 9 and 12. In order to facilitate the understanding of the invention, here is described a case where a line latent image is formed by aligning a plurality of spots on a straight line extending in the main scanning direction MD. Roughly, in such a latent image forming operation, the plurality of light emitting elements are driven for light emission at specified timings in accordance with the video data VD outputted from the head controller HC while the surface of the photosensitive drum 21 is conveyed in the sub scanning direction SD (the width direction LTD), whereby the plurality of spots are formed while being aligned on the straight line extending in the main scanning direction MD (the longitudinal direction LGD). This is described in detail below.

First of all, out of the light emitting element rows 2951R belonging to the most upstream light emitting element groups 295A1, 295A2, . . . in the width direction LTD, the light emitting element rows 2951R downstream in the width direction LTD are driven for light emission. A plurality of light beams emitted by such a light emitting operation are imaged on the surface of the photosensitive drum by the lenses LS. In this embodiment, the lenses LS have an inversion characteristic, so that the light beams from the light emitting elements 2951 are imaged in an inverted manner. In this way, spots are formed at hatched positions of a "FIRST" of FIG. 12. In FIG. 12, white circles represent spots that are not formed yet, but planned to be formed later. In FIG. 12, spots labeled by reference numerals 295C1, 295B1, 295A1 and 295C2 are those to be formed by the light emitting element groups 295 corresponding to the respective attached reference numerals.

Subsequently, out of the light emitting element rows 2951R belonging to the most upstream light emitting element groups 295A1, 295A2, . . . , the light emitting element rows 2951R upstream in the width direction LTD are driven for light emission. A plurality of light beams emitted by such a light emitting operation are imaged on the surface of the photosensitive drum by the lenses LS. In this way, spots are formed at hatched positions of a "SECOND" of FIG. 12. Here, the light emitting element rows 2951R are successively driven for light emission from the one downstream in the width direction LTD in order to deal with the inversion characteristic of the lenses LS.

Subsequently, out of the light emitting element rows 2951R belonging to the second most upstream light emitting element groups 295B1, . . . in the width direction LTD, the light emitting element rows 2951R downstream in the width direction LTD are driven for light emission. A plurality of light beams emitted by such a light emitting operation are imaged on the surface of the photosensitive drum by the lenses LS. In this way, spots are formed at hatched positions of a "THIRD" of FIG. 12.

Subsequently, out of the light emitting element rows 2951R belonging to the second most upstream light emitting element groups 295B1, . . . , the light emitting element rows 2951R upstream in the width direction LTD are driven for light emission. A plurality of light beams emitted by such a light emitting operation are imaged on the surface of the photosensitive drum by the lenses LS. In this way, spots are formed at hatched positions of a "FOURTH" of FIG. 12.

Subsequently, out of the light emitting element rows 2951R belonging to the third most upstream light emitting element groups 295C1, . . . in the width direction LTD, the light emitting element rows 2951R downstream in the width direction LTD are driven for light emission. A plurality of light beams emitted by such a light emitting operation are imaged on the surface of the photosensitive drum by the lenses LS. In this way, spots are formed at hatched positions of a "FIFTH" of FIG. 12.

Finally, out of the light emitting element rows 2951R belonging to the third most upstream light emitting element groups 295C1, . . . , the light emitting element rows 2951R upstream in the width direction LTD are driven for light emission. A plurality of light beams emitted by such a light emitting operation are imaged on the surface of the photosensitive drum by the lenses LS. In this way, spots are formed at hatched positions of a "SIXTH" of FIG. 12. By performing the first to the sixth light emitting operations in this way, a plurality of spots are formed while being aligned on the straight line extending in the longitudinal direction LGD (the main scanning direction MD).

As described above, in the first embodiment, a plurality of light emitting element group rows 295R are arranged in the width direction LTD. In each light emitting element group row 295R, a plurality of light emitting element groups 295 are arranged with the spaces SC defined between adjacent ones and the respective light emitting element group rows 295R are displaced from each other in the longitudinal direction LGD so that the positions of the light emitting element groups 295 mutually differ in the longitudinal direction LGD. Accordingly, the wirings WL can be easily drawn to the one side area AR by passing the wirings WL drawn toward the one side area AR via the other light emitting element group row(s) 295R through the spaces SC of the other light emitting element group row(s) 295R. Thus, the FPCs 310 connected with the wirings WL via the driver ICs 300 can also be provided in this one side area AR, wherefore it is possible to simplify the production process of the line head 29 and to suppress the production cost.

In other words, in the first embodiment, the connecting portions 2931 are arranged at the one side of the light emitting element groups 295B1, 295B2 opposite to the light emitting element group 295A2 in the width direction LTD. The wirings WL connected with the light emitting elements 2951 of the light emitting element group 295A2 (corresponding to a "first light emitting element group" of the invention) are electrically connected with the connecting portions 2931 while passing between the light emitting element group 295B1 (corresponding to a "second light emitting element group" of the invention) and the light emitting element group 295B2 (corresponding to a "third light emitting element group" of the invention). Further, the connecting portions 2931 are arranged at the one side of the light emitting element groups 295C1, 295C2 opposite to the light emitting element group 295B2 in the width direction LTD. The wirings WL connected with the light emitting elements 2951 of the light emitting element group 295B2 (corresponding to the "first light emitting element group" of the invention) are electrically connected with the connecting portions 2931 while passing between the light emitting element group 295C1 (corresponding to the "second light emitting element group" of the invention) and the light emitting element group 295C2 (corresponding to the "third light emitting element group" of the invention). Accordingly, the spaces between the light emitting element groups 295B1 and 295B2 and between the light emitting element groups 295C1 and 295C2 can be effectively utilized. In this way, it is possible to suppress the enlargement of the head substrate 293 and to reduce the production cost of the line head 29.

In the first embodiment, the driver ICs 300 are provided on the head substrate 293. Accordingly, in the first embodiment, the driver ICs 300 can be arranged relatively close to the light emitting elements 2951, wherefore drive signals with less dampening due to stray capacitance and the like can be supplied to the light emitting elements 2951.

In the first embodiment, three light emitting element group rows 295R are arranged in the width direction LTD. Further, in each light emitting element group 295, two light emitting element rows 2951R each including four light emitting elements 2951 aligned in the longitudinal direction LGD are arranged in the width direction LTD. However, the number of the light emitting element group rows 295R and the configuration of the light emitting element groups 295 are not limited to the contents of the first embodiment and can also be changed, for example, as follows.

C. Second Embodiment

Figure 13:
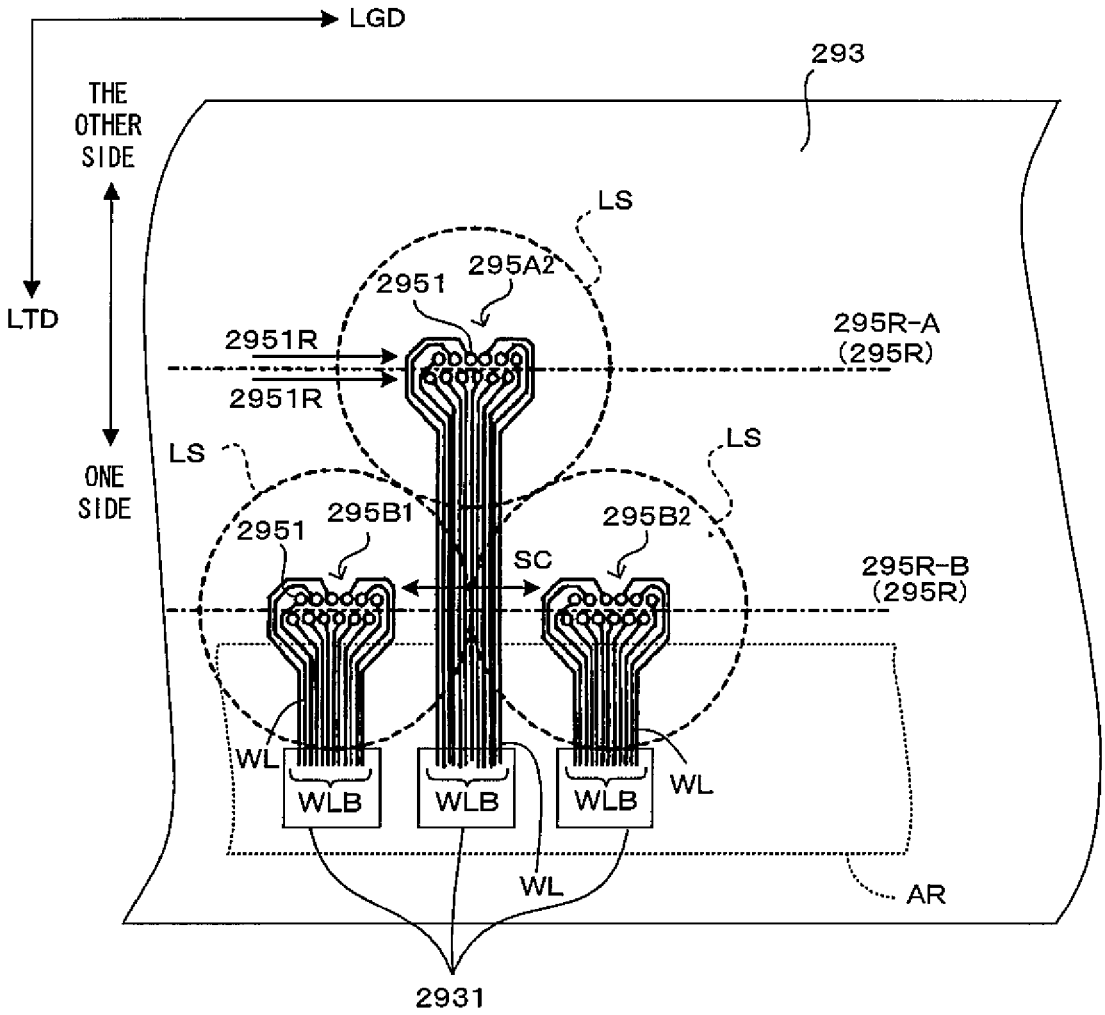
FIG. 13 is a plan view showing a connection mode of wirings with light emitting element groups according to a second embodiment.
Figure 14:
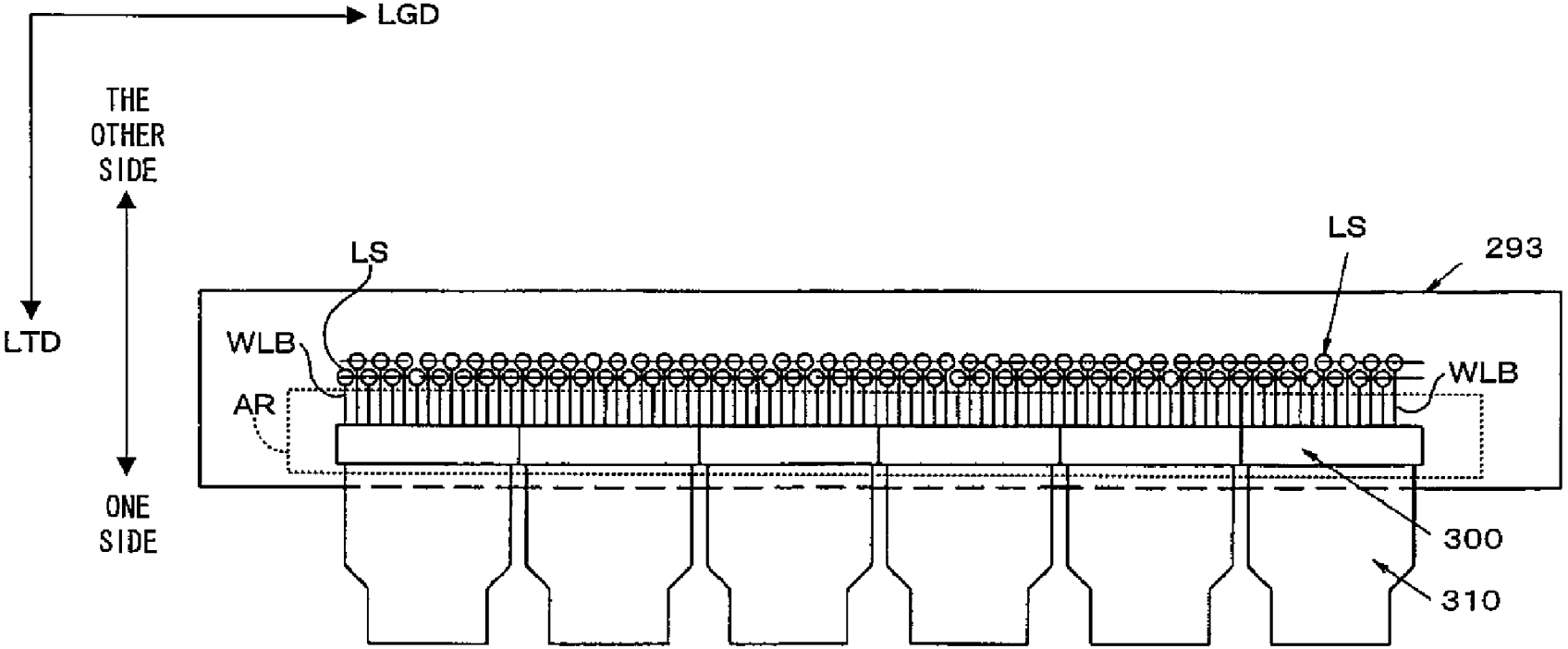
FIG. 14 is a diagram showing an arrangement relationship of wiring bundles and driver ICs according to the second embodiment.

FIG. 13 is a plan view showing a connection mode of wirings with light emitting element groups according to a second embodiment, and FIG. 14 is a diagram showing an arrangement relationship of wiring bundles and driver ICs according to the second embodiment. Points of difference from the first embodiment are mainly described below and common parts are not described by being identified by equivalent reference numerals. As shown in FIG. 13, in the second embodiment, two light emitting element group rows 295R are arranged in the width direction LTD. In other words, in the second embodiment, a plurality of light emitting element group rows 295R are arranged while being offset in the longitudinal direction LGD. As shown in FIG. 14, a plurality of lenses LS are also arranged while being offset in the longitudinal direction LGD in conformity with such an arrangement of the light emitting element groups 295. In each light emitting element group 295, two light emitting element rows 2951R each including six light emitting elements 2951 aligned in the longitudinal direction LGD are arranged in the width direction LTD (FIG. 13). These light emitting element rows 2951R are displaced from each other in the longitudinal direction LGD, with the result that the positions of the respective light emitting elements 2951 mutually differ in the longitudinal direction LGD.

As described above, the plurality of light emitting element group rows 295R are arranged in the width direction LTD also in the second embodiment. Further, as shown in FIG. 13, a plurality of light emitting element groups 295 are arranged with spaces SC defined between adjacent ones in the light emitting element group rows 295R, and the respective light emitting element group rows 295R are displaced from each other in the longitudinal direction LGD so that the positions of the respective light emitting element groups 295 mutually differ in the longitudinal direction LGD. Accordingly, the wirings WL can be easily drawn to the one side area AR by passing the wirings WL drawn from one light emitting element group row 295R (light emitting element group row 295R_A) via the other light emitting element group row 295R (light emitting element group row 295R_B) through the spaces SC of the other light emitting element group row 295R (light emitting element group row 295R_B). Thus, FPCs 310 connected with the wirings WL via the driver ICs 300 can be provided in this one side area AR, wherefore it is possible to simplify the production process of a line head 29 and to suppress the production cost.

In other words, connecting portions 2931 are provided in a one side area AR also in the second embodiment. Specifically, the connecting portions 2931 are arranged at one side of the light emitting element groups 295B1, 295B2 opposite to the light emitting element group 295A2 in the width direction LTD. The wirings WL connected with the light emitting elements 2951 of the light emitting element group 295A2 (corresponding to the "first light emitting element group" of the invention) are electrically connected with the connecting portions 2931 while passing between the light emitting element group 295B1 (corresponding to the "second light emitting element group" of the invention) and the light emitting element group 295B2 (corresponding to the "third light emitting element group" of the invention). Accordingly, the space between the light emitting element groups 295B1 and 295B2 can be effectively utilized. In this way, it is possible to suppress the enlargement of the head substrate 293 and to reduce the production cost of the line head 29.

In the first and the second embodiments, the driver ICs 300 are provided on the head substrate 293. However, the arrangement positions of the driver ICs 300 are not limited to these and can be changed as follows.

D. Third Embodiment

Figure 15:
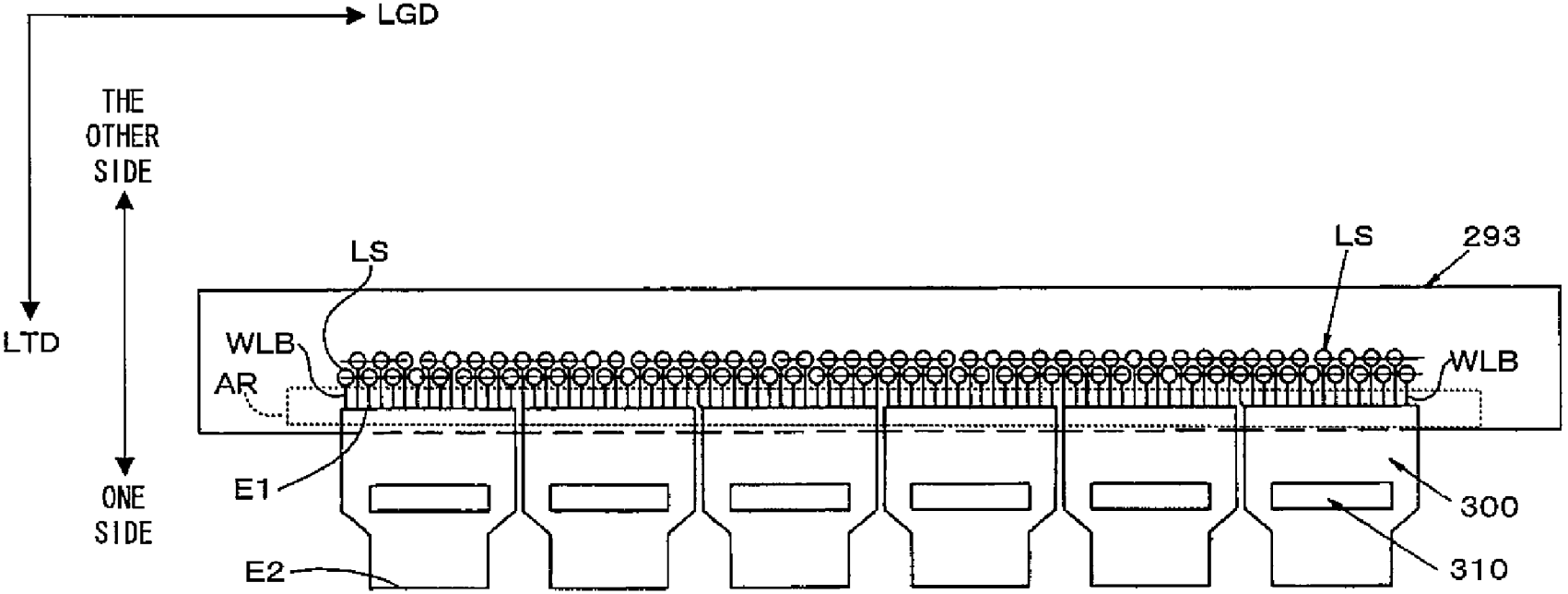
FIG. 15 is a diagram showing an arrangement relationship of wiring bundles and driver ICs according to a third embodiment.

FIG. 15 is a diagram showing an arrangement relationship of wiring bundles and driver ICs according to a third embodiment. Points of difference from the first and second embodiments are mainly described below and common parts are not described by being identified by equivalent reference numerals. As shown in FIG. 15, one end E1 of each FPC 310 mounted in a one side area AR of a head substrate 293 is connected with a wiring bundle WLB (or wirings WL). In the third embodiment, each driver IC 300 is provided between the one end E1 and another end E2 of the corresponding FPC 310. The driver ICs 300 are mounted on the FPCs 310 by so-called chip on film technology.

Accordingly, when a head controller HC outputs video data VD at a suitable timing (FIG. 4), this video data VD is inputted to the other ends E2 of the FPCs 310. The video data VD inputted to the other ends E2 of the FPCs 310 in this way is converted into drive signals by the driver ICs 300 mounted on the FPCs 310 and outputted from the one ends E1 of the FPCs 310. Light emitting elements 2951 are driven by these drive signals.

As described above, the FPCs 310 are provided in the one side area AR also in the third embodiment and it is possible to simplify the production process of a line head 29 and to suppress the production cost thereof.

In the third embodiment, each driver IC 300 is provided between the one end E1 and the other end E2 of the corresponding FPC 310. Accordingly, it is not necessary to provide the driver ICs 300 on the head substrate 293, wherefore the head substrate 293 can be made smaller and the line head 29 can have a compact construction.

E. Fourth Embodiment

Figure 16:
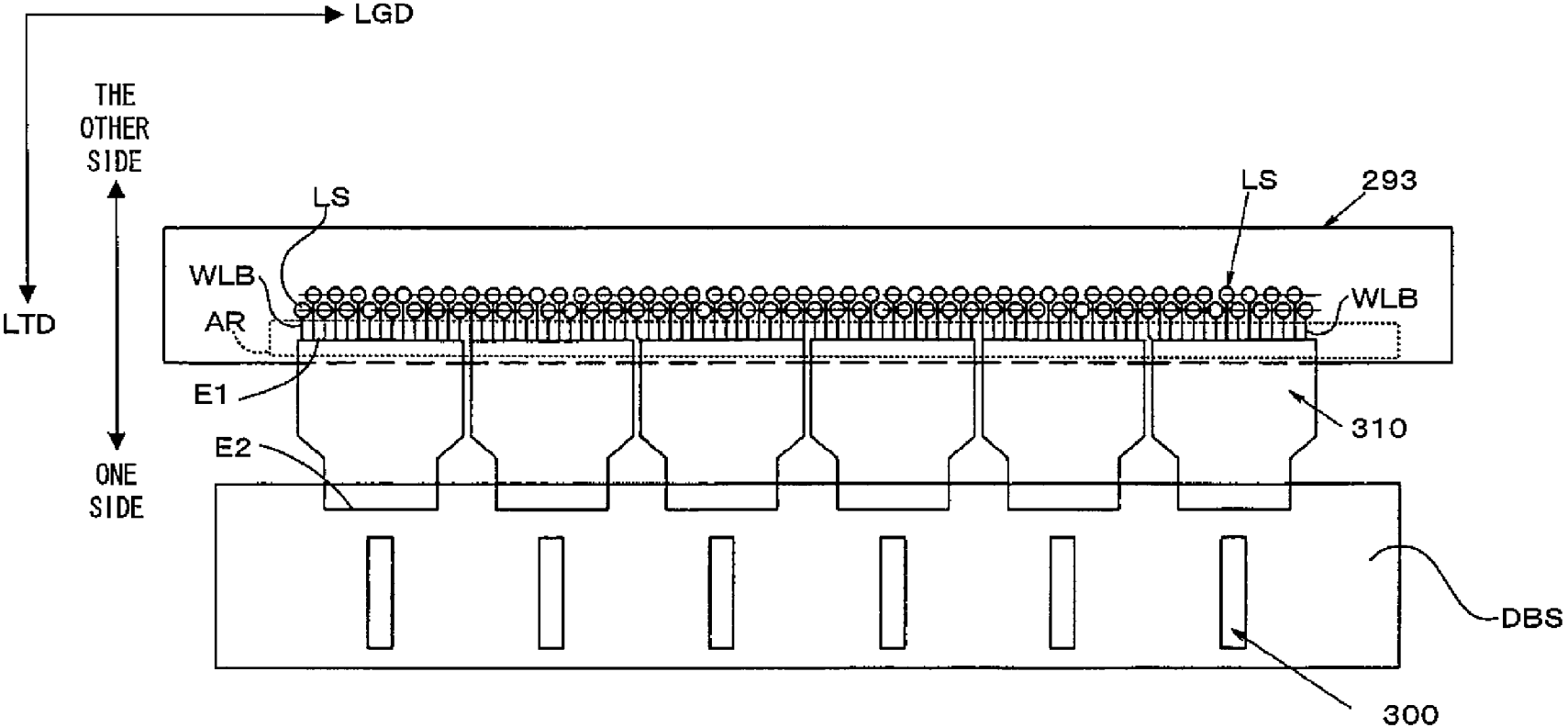
FIG. 16 is a diagram showing an arrangement relationship of wiring bundles and driver ICs according to a fourth embodiment.

FIG. 16 is a diagram showing an arrangement relationship of wiring bundles and driver ICs according to a fourth embodiment. Points of difference from the above embodiments are mainly described below and common parts are not described by being identified by equivalent reference numerals. As shown in FIG. 16, a plurality of FPCs 310 are mounted side by side in the longitudinal direction LGD. One end E1 of each FPC 310 mounted in a one side area AR of the head substrate 293 is connected with a wiring bundle WLB (wirings WL). Other ends E2 of the FPCs 310 are mounted on a driver IC substrate DBS made of glass as a base material and are connected with the driver ICs 300 on the driver IC substrate DBS. In other words, a plurality of driver ICs 300 are mounted on the driver IC substrate DBS by chip on glass technology, and the respective driver ICs 300 are connected with the other ends E2 of the FPCs 310. Video data VD from a head controller HC can be inputted to the driver ICs 300.

Specifically, when the head controller HC outputs the video data VD at a suitable timing (FIG. 4), this video data VD is converted into drive signals by the driver ICs 300 and these drive signals are inputted to light emitting elements 2951 via the FPCs 310. The respective light emitting elements 2951 are driven by these drive signals.

As described above, the FPCs 310 are provided in the one side area AR also in the fourth embodiment and it is possible to simplify the production process of a line head 29 and to suppress the production cost thereof.

In the fourth embodiment, the plurality of driver ICs 300 are provided on the driver IC substrate DBS different from the head substrate 293. Thus, the driver ICs 300 can be relatively freely arranged and laid out, whereby the cost of the driver ICs 300 can be suppressed.

F. Fifth Embodiment

Figure 17:
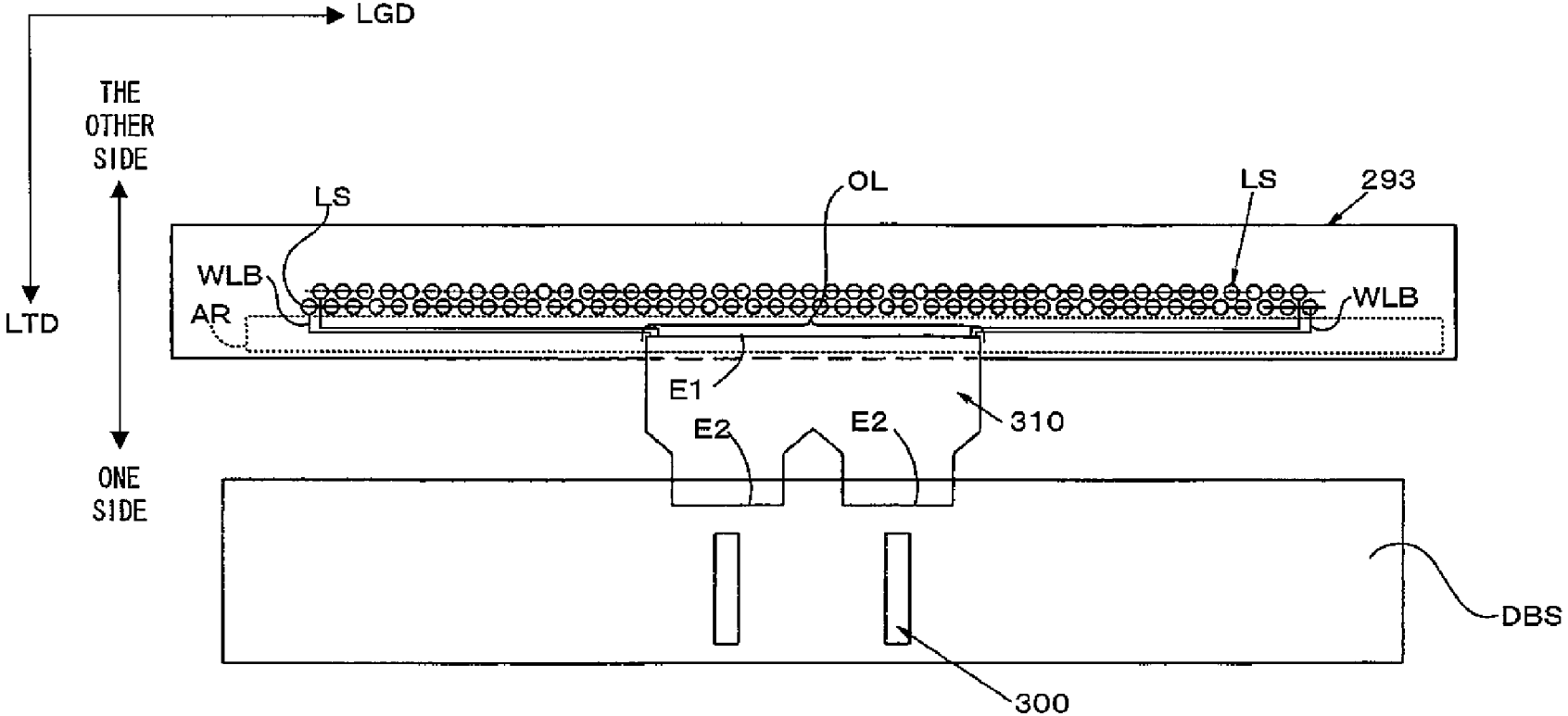
FIG. 17 is a diagram showing an arrangement relationship of wiring bundles and driver ICs according to a fifth embodiment.

FIG. 17 is a diagram showing an arrangement relationship of wiring bundles and driver ICs according to a fifth embodiment. Only wiring bundles WLB drawn from some of lenses LS are shown in FIG. 17. Points of difference from the above embodiments are mainly described below and common parts are not described by being identified by equivalent reference numerals. As shown in FIG. 17, the wiring bundles WLB drawn from the respective lenses LS to a one side area AR are collected at one location OL in the longitudinal direction LGD. Further, one FPC 310 is provided on a head substrate 293. In other words, one end E1 of the FPC 310 is mounted in the one side area AR of the head substrate 293 and connected with the wiring bundles WLB (or wirings WL). Another end E2 of the FPC 310 is mounted on a driver IC substrate DBS made of glass as a base material. Driver ICs 300 are mounted on the driver IC substrate DBS by chip on glass technology. Video data VD from a head controller HC is inputted to the driver ICs 300.

Accordingly, when the head controller HC outputs the video data VD at a suitable timing (FIG. 4), this video data VD is converted into drive signals by the driver ICs 300 and these drive signals are inputted to light emitting elements 2951 via the FPC 310. The respective light emitting elements 2951 are driven by these drive signals.

As described above, the FPC 310 is provided in the one side area AR also in the fifth embodiment and it is possible to simplify the production process of a line head 29 and to suppress the production cost thereof.

In the fifth embodiment, the respective drawn wirings WL are collected at one location in the longitudinal direction LGD, and the one end E1 of the FPC 310 are connected with the respective wirings WL. Accordingly, in the fifth embodiment, the production cost can be suppressed since it is sufficient to mount one FPC 310 on the head substrate 293 and to perform the process of mounting the FPC 310 once.

G. Sixth Embodiment

Figure 18:
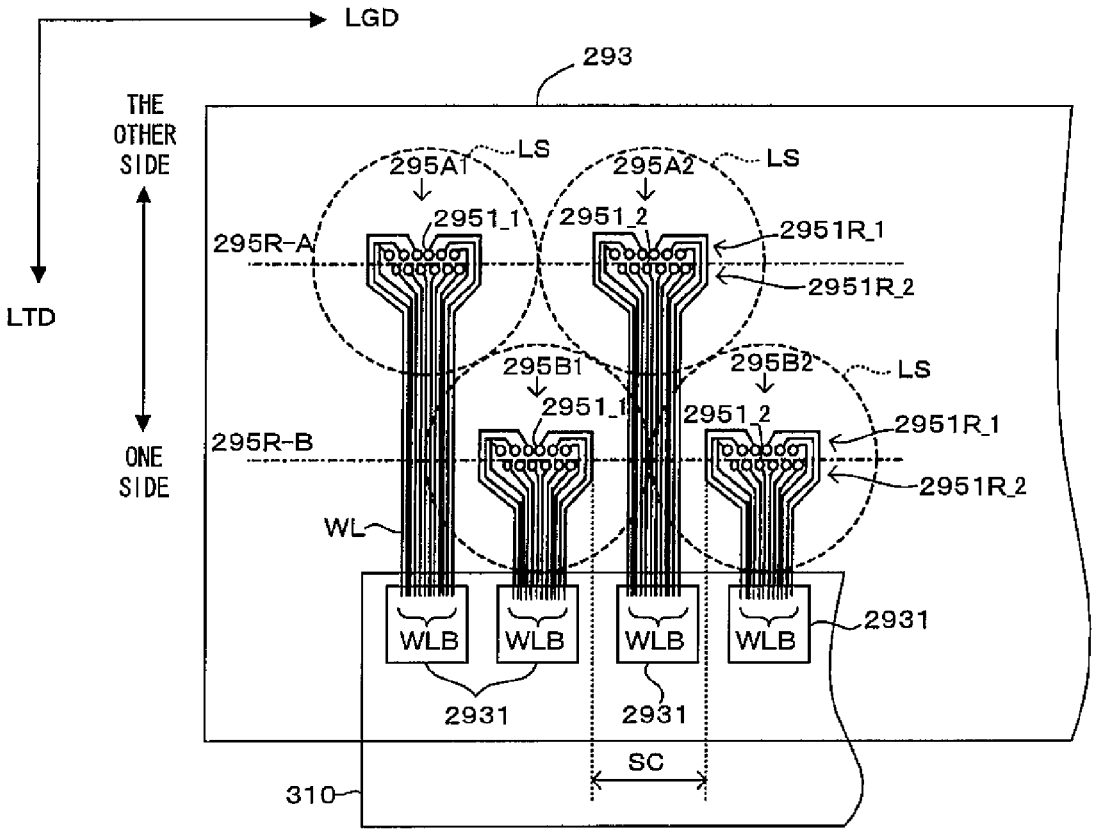
FIG. 18 is a plan view showing a connection mode of wirings with light emitting element groups according to a sixth embodiment.

FIG. 18 is a plan view showing a connection mode of wirings with light emitting element groups according to a sixth embodiment. Points of difference from the above embodiments are mainly described below and common parts are not described by being identified by equivalent reference numerals.

In this sixth embodiment, two light emitting element group rows, that is, light emitting element group rows 295R_A, 295R_B are arranged on a head substrate 293. Each light emitting element group 295 includes two light emitting element rows, that is, light emitting element row 2951R_2 (corresponding to a "second light emitting element row" of the invention) at one side (connecting portion side) and a light emitting element row 2951R_1 (corresponding to a "first light emitting element row" of the invention) at the other side. Similar to the first embodiment shown in FIG. 10, a plurality of wirings WL connected with each light emitting element group 295 is bundled into a wiring bundle WLB, which is drawn to the outside of a lens LS. Similar to the first embodiment, the wirings WL drawn from the respective light emitting element groups 295 are all electrically connected with connecting portions 2931 at one side of the head substrate 293 in the width direction LTD. Further, similar to the first embodiment, the wirings WL drawn from the light emitting element group 295A2 (corresponding to the "first light emitting element group" of the invention) are electrically connected with the connecting portion 2931 at the one side while passing through a space SC between the light emitting element group 295B1 (corresponding to the "second light emitting element group" of the invention) and the light emitting element group 295B2 (corresponding to the "third light emitting element group"). Thus, similar to the first embodiment, the spaces between the light emitting element groups can be effectively utilized. A FPC 310 is attached to the connecting portions 2931 by an anisotropic conductive film, for example.

In the sixth embodiment, the wirings WL (corresponding to "first wiring" of the invention) drawn from light emitting elements (for example, light emitting element 2951_1, corresponding to "first light emitting element" of the invention) belonging to the light emitting element row 2951R_1 (corresponding to the "first light emitting element row" of the invention) at the other side are first drawn toward the other side opposite to the connecting portions 2931 and then bent to pass at the outer sides of the light emitting element row 2951R_2 at the one side to be electrically connected with the connecting portion 2931 at the one side. The wirings WL (corresponding to "second wiring" of the invention) drawn from the light emitting elements (for example, light emitting element 2951_2, corresponding to "second light emitting elements" of the invention) belonging to the light emitting element row 2951R_2 (corresponding to the second light emitting element row" of the invention) at the one side are directly drawn toward the connecting portions 2931 at the one side.

The wirings (corresponding to the "first wiring" of the invention) WL drawn from the light emitting elements 2951 on the left half in FIG. 18 out of the light emitting elements 2951 belonging to the light emitting element row 2951R_1 at the other side of the light emitting element group 295A2 are arranged between the light emitting element group 295A2 (corresponding to the "first light emitting element group" of the invention) and the light emitting element group 295A1 (corresponding to a "fourth light emitting element group" of the invention). As descried above, according to the sixth embodiment, the wirings WL do not pass clearances between the light emitting elements 2951 belonging to the light emitting element row 2951R_2 at the one side. Therefore, intervals between the light emitting elements 2951 can be shortened.

H. Seventh Embodiment

Figure 19:
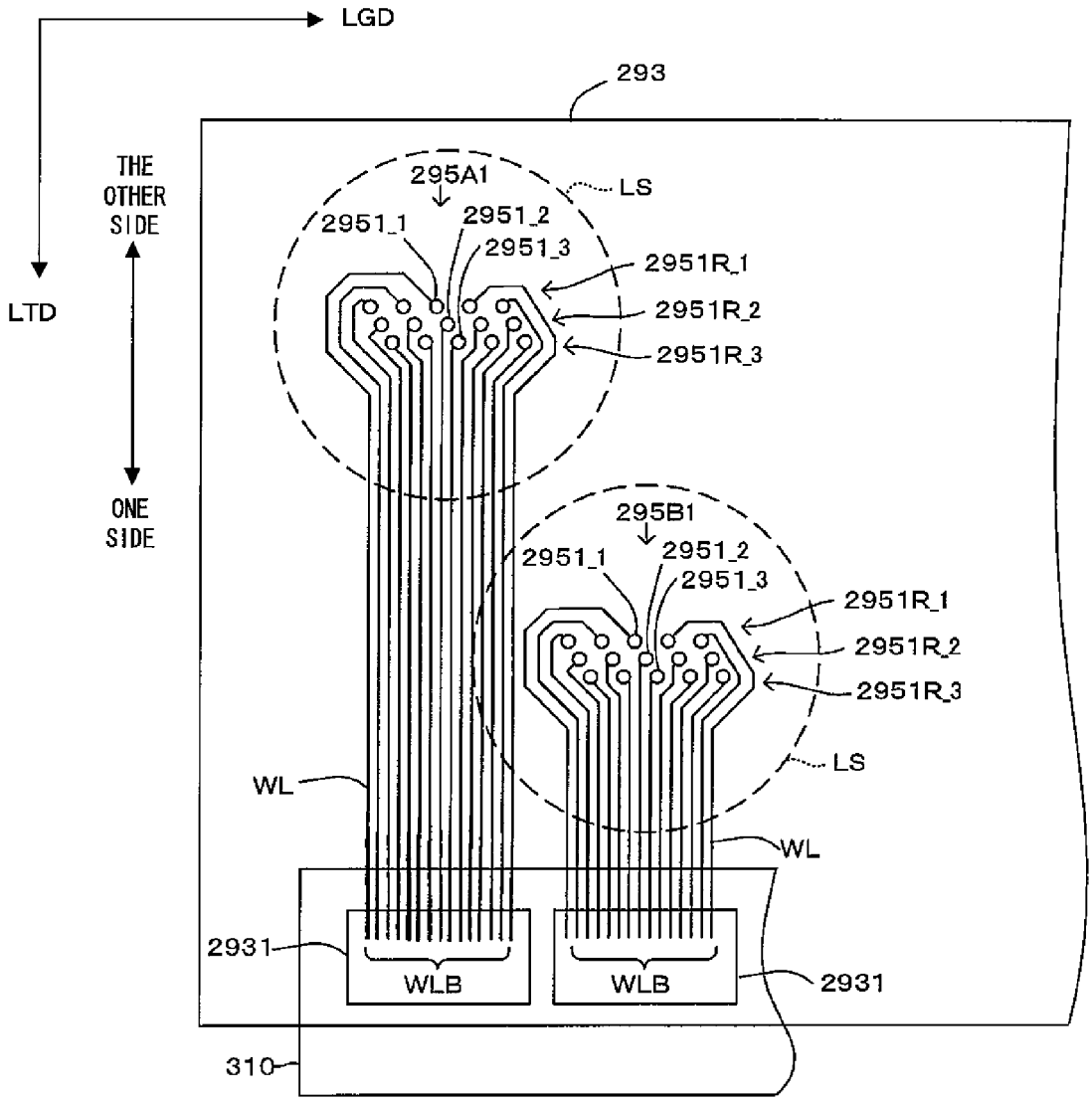
FIG. 19 is a plan view showing a connection mode of wirings with light emitting element groups according to a seventh embodiment.

FIG. 19 is a plan view showing a connection mode of wirings with light emitting element groups according to a seventh embodiment. Points of difference from the above sixth embodiment are mainly described below and common parts are not described by being identified by equivalent reference numerals.

Each light emitting element group 295 includes two light emitting element rows in the sixth embodiment, whereas it includes three light emitting element rows in the seventh embodiment. Specifically, a light emitting element row 2951R_3 (corresponding to a "third light emitting element row" of the invention) is further provided at one side (side toward connecting portions 2931) of a light emitting element row 2951R_2 (corresponding to the "second light emitting element row" of the invention) in the width direction LTD. In the seventh embodiment, similar to the sixth embodiment, wirings WL (corresponding to the "first wiring" of the invention) drawn from light emitting elements (for example, light emitting element 2951_1, corresponding to the "first light emitting element" of the invention) belonging to a light emitting element row 2951R_1 closest to the other side are first drawn toward the other side (side opposite to the connecting portions 2931) and then bent to pass at the outer sides of the light emitting element rows 2951R_2, 2951R_3 to be electrically connected with the connecting portions 2931 at the one side.

The wirings WL drawn from the light emitting elements belonging to the light emitting element rows 2951R_2, 2951R_3 (for example, light emitting elements 2951_2, 2951_3) are directly drawn toward the one side to be electrically connected with the connecting portions 2931. In other words, the wirings (corresponding to the "second wiring" of the invention) WL drawn from the light emitting elements (for example, light emitting element 2951_2) belonging to the light emitting element row 2951R_2 are electrically connected with the connecting portions 2931 at the one side while passing between the light emitting elements (for example, light emitting element 2951_3) belonging to the light emitting element row 2951R_3. In this way, according to the seventh embodiment, it is maximally prevented to pass the wirings through clearances between the light emitting elements 2951 belonging to the light emitting element row 2951R. Therefore, intervals between the light emitting elements 2951 can be shortened.

Although each light emitting element group 295 includes three light emitting element rows 2951R_1, 2951R_2 and 2951R_3 successively from the other side toward the one side in the seventh embodiment, the number of light emitting element rows is not limited to this. For example, each light emitting element group 295 may include N (N is an odd number equal to or greater than 3) light emitting element rows successively from one side toward the other side. In this modification, wirings drawn from the light emitting elements belonging to (N−1)/2 light emitting element rows arranged at the other side may be first drawn toward the other side and then bent to pass at the outer sides of the light emitting element rows arranged at the one side and to be electrically connected with the connecting portions 2931 at the one side. In this way, it is maximally prevented to pass the wirings through clearances between the light emitting elements belonging to the light emitting element rows.

I. Eighth Embodiment

Figure 20:
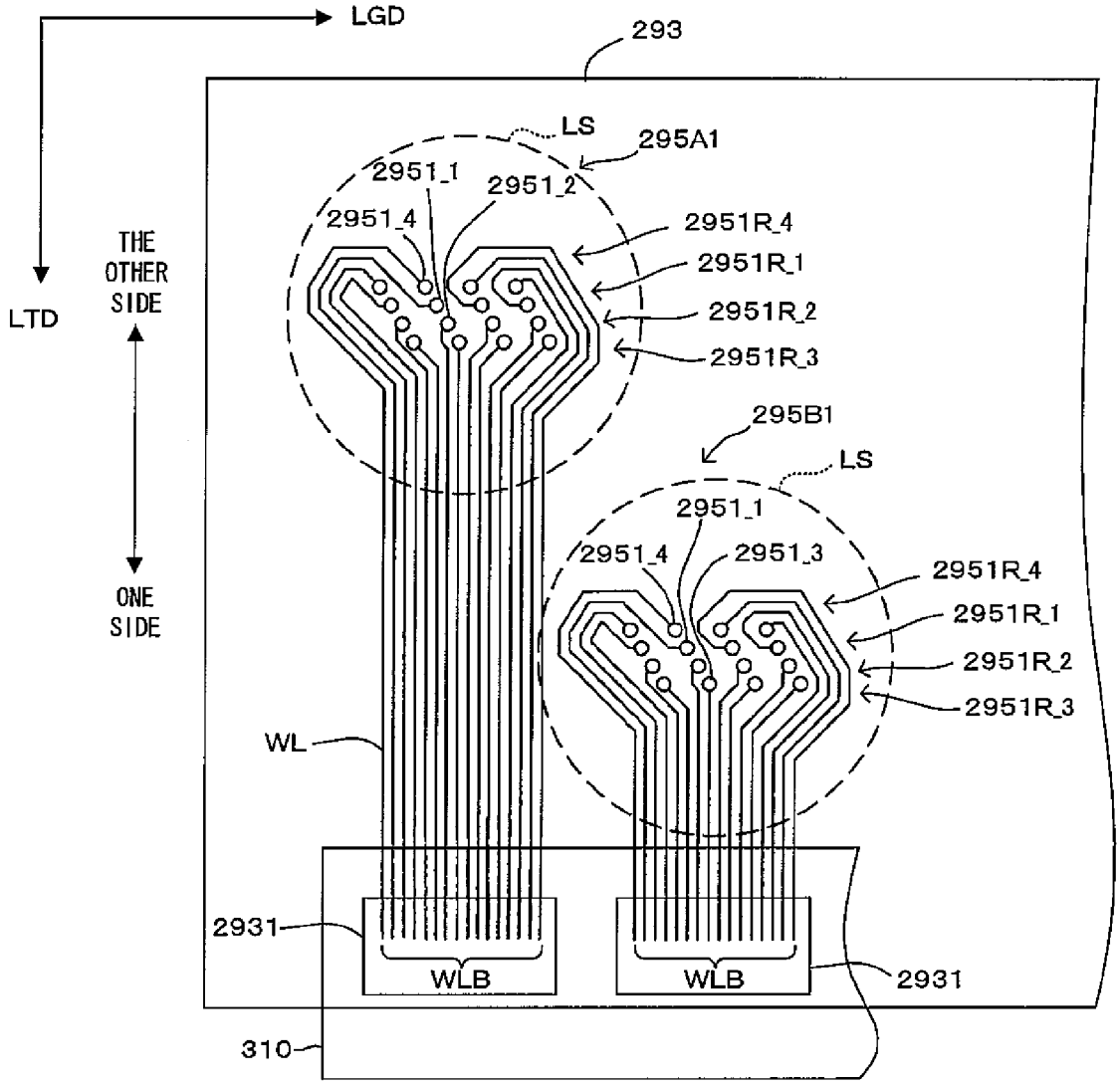
FIG. 20 is a plan view showing a connection mode of wirings with light emitting element groups according to an eighth embodiment.

FIG. 20 is a plan view showing a connection mode of wirings with light emitting element groups according to an eighth embodiment. Points of difference from the above seventh embodiment are mainly described below and common parts are not described by being identified by equivalent reference numerals.

Each light emitting element group 295 includes three light emitting element rows in the seventh embodiment, whereas it includes four light emitting element rows in this eighth embodiment. Specifically, a light emitting element row 2951R_4 (corresponding to a "fourth light emitting element row" of the invention) is further provided at the other side (side opposite to connecting portions 2931) of a light emitting element row 2951R_1 (corresponding to the "first light emitting element row" of the invention) in the width direction LTD. In the eighth embodiment, similar to the seventh embodiment, wirings WL drawn from light emitting elements (for example, light emitting element 2951_4) belonging to the light emitting element row 2951R_4 closest to the other side are first drawn toward the other side and then bent to pass at the outer sides of the light emitting element rows 2951R_1 to 2951R_3 to be electrically connected with the connecting portions 2931.

The wirings (corresponding to the "first wiring" of the invention) WL drawn from the light emitting elements (for example, light emitting element 2951_1, corresponding to the "first light emitting element" of the invention) belonging to the light emitting element row 2951R_1 are also first drawn toward the other side and then bent to pass the outer sides of the light emitting element rows 2951R_2, 2951R_3 and to be electrically connected with the connecting portions 2931 similar to the seventh embodiment. At this time, the wirings (corresponding to the "first wiring" of the invention) WL drawn from the light emitting elements (for example, light emitting element 2951_1, corresponding to the "first light emitting element" of the invention) belonging to the light emitting element row 2951R_1 are drawn toward the one side while passing between the light emitting elements (e.g. light emitting element 2951_4) belonging to the light emitting element row 2951R_4, and are electrically connected with the connecting portions 2931.

Similar to the seventh embodiment, the wirings WL drawn from the light emitting elements belonging to the light emitting element rows 2951R_2, 2951R_3 (for example, light emitting elements 2951_2, 2951_3) are directly drawn toward the one side to be electrically connected with the connecting portions 2931. In other words, the wirings (corresponding to a "second wiring" of the invention) WL drawn from the light emitting elements (for example, light emitting element 2951_2) belonging to the light emitting element row 2951R_2 are drawn toward the one side while passing between the light emitting elements (for example, light emitting element 2951_3) belonging to the light emitting element row 2951R_3 and are connected with the connecting portions 2931. In this way, according to the eighth embodiment, it is maximally prevented to pass the wirings through clearances between the light emitting elements 2951 belonging to the light emitting element rows 2951R. Therefore, intervals between the light emitting elements 2951 can be shortened.

Although each light emitting element group 295 includes four light emitting element rows 2951R_4, 2951R_1, 2951R_2 and 2951R_3 successively from the other side toward the one side in the eighth embodiment, the number of light emitting element rows is not limited to this. For example, each light emitting element group 295 may include M (M is an even number equal to or greater than 2) light emitting element rows successively from one side toward the other side. In this modification, wirings drawn from the light emitting elements belonging to M/2 light emitting element rows arranged at the other side may be first drawn toward the other side and then bent to pass at the outer sides of the light emitting element row(s) arranged at the one side and to be electrically connected with the connecting portions 2931 at the one side. In this way, it is maximally prevented to pass the wirings through clearances between the light emitting elements belonging to the light emitting element rows.

J. Miscellaneous

As described above, in the first to eighth embodiments, the longitudinal direction LGD corresponds to a "first direction" of the invention, the width direction LTD to a "second direction" of the invention, the photosensitive drum 21 to a "latent image carrier" of the invention and the surface of the photosensitive drum 21 to an "image plane" of the invention. Further, the FPC 310 corresponds to a "connecting member" of the invention, the video data VD to an "emission control signal" of the invention, and the video data VD and the drive signals to "signals relating to the emission control signal" of the invention. Furthermore, the FPC 310 corresponds to a "connection circuit" of the invention, and the driver IC substrate DBS to a "driver board" of the invention.

The invention is not limited to the above embodiments and various changes other than the above can be made without departing from the gist thereof. For example, in the above embodiments, the light emitting element group 295 is made up of two light emitting element rows 2951R arranged in the width direction LTD. However, the configuration of the light emitting element group 295 is not limited to this. For example, the number of the light emitting element rows 2951R may be three or more.

Although two or three light emitting element group rows 295R are arranged in the width direction LTD in the above embodiments, the number of the light emitting element group rows 295R is not limited to this and may be three or more.

In the first embodiment, the driver ICs 300 are used as an "electrical circuit" of the invention. However, it is also possible to use circuits other than the driver ICs as the "electrical circuit" of the invention.

The respective light emitting elements 2951 may be driven by so-called time-division driving. Specifically, the respective light emitting elements 2951 may be driven by time-division driving proposed in JP-A-11-268333, JP-A-2007-203555, JP-A-2007-160650 or the like. In the case of such a construction, it is possible to reduce the number of the driver ICs 300, and hence, to suppress the production cost.

In the above embodiments, organic EL devices are used as the light emitting elements 2951. However, the construction of the light emitting elements 2951 is not limited to this. For example, LEDs (light emitting diodes) may be used as the light emitting elements 2951.

In the above embodiments, the FPC 310 is used as the "connecting member". Specifically, in the first and second embodiments, the FPC 310 having the video data VD inputted to the other end E2 and having this video data VD outputted from the one end E1 functions as the "connecting member". In the third embodiment, the FPC 310 having the video data VD inputted to the other end E2 and having the drive signals obtained by converting the video data VD outputted from the one end E1 functions as the "connecting member". In the fourth and fifth embodiments, the FPC 310 having the drive signals inputted to the other end E2 and having these drive signals outputted from the one end E1 functions as the "connecting member". However, similar to such FPCs 310, another member capable of outputting signals corresponding to signals inputted to another end E2 from one end E1 can also be used as the "connecting member".

An embodiment of a line head according to the invention, comprises: a head substrate; a first light emitting element group which is arranged on the head substrate and includes a first light emitting element and a second light emitting element; a second light emitting element group and a third light emitting element group which are arranged in a first direction on the head substrate; a first wiring which is arranged between the second and the third light emitting element groups on the head substrate and is electrically connected with the first light emitting element; a second wiring which is arranged between the second and the third light emitting element groups on the head substrate and is electrically connected with the second light emitting element; and a connecting portion which is arranged on the head substrate and is electrically connected with the first and the second wirings.

An embodiment of an image forming apparatus according to the invention, comprises: a head substrate; a first light emitting element group which is arranged on the head substrate and includes a first light emitting element and a second light emitting element; a second light emitting element group and a third light emitting element group which are arranged in a first direction on the head substrate; a first wiring which is arranged between the second and the third light emitting element groups on the head substrate and is electrically connected with the first light emitting element; a second wiring which is arranged between the second and the third light emitting element groups on the head substrate and is electrically connected with the second light emitting element; a connecting portion which is arranged on the head substrate and is electrically connected with the first and the second wirings; and a controller which is adapted to output an emission control signal which controls light emissions of the light emitting elements.

According to the embodiment (line head, image forming apparatus) thus constructed, a first light emitting element group including first and second light emitting elements and second and third light emitting element groups arranged in a first direction are arranged on a head substrate. Further, a first wiring electrically connected with the first light emitting element, a second wiring electrically connected with the second light emitting element and a connecting portion electrically connected with the first and the second wirings are provided on this head substrate. Here, the first and the second wirings are arranged between the second and the third light emitting element groups. Accordingly, the first and the second wirings can be suitably electrically connected with the connecting portion effectively utilizing a space between the second and the third light emitting element groups. As a result, the head substrate can be downsized, whereby the production cost of the line head can be reduced.

The first light emitting element group may include a first light emitting element row made up of light emitting elements which include the first light emitting element and are arranged in the first direction and a second light emitting element row made up of light emitting elements which include the second light emitting element and are arranged in the first direction, and the second light emitting element row may be located closer to the connecting portion than the first light emitting element row.

Further, the embodiment may comprise a fourth light emitting element group arranged in the first direction of the first light emitting element group, and the first wiring may be arranged between the first and the fourth light emitting element groups. By such a construction, the first wiring can be suitably electrically connected with the connecting portion effectively utilizing a space between the first and the fourth light emitting element groups. Here, the first wiring may be arranged at a side opposite to a side where the connecting portion is arranged, and may be electrically connected with the connecting portion. According to this construction, it can be reliably avoided that the first wiring passes between the light emitting elements belonging to the second light emitting element row. Therefore, intervals between the light emitting elements can be shortened.

The first light emitting element group may include a third light emitting element row located closer to the connecting portion than the second light emitting element row and the second wiring may be arranged between light emitting elements of the third light emitting element row. According to this construction, only the second wiring is arranged between the light emitting elements of the third light emitting element row, and hence, an increase in intervals between the light emitting elements of the third light emitting element row can be minimized.

The first light emitting element group may include a fourth light emitting element row located closer to a side opposite to the connecting portion than the first light emitting element row and the first wiring may be arranged between the light emitting elements of the fourth light emitting element row. According to this construction, only the first wiring is arranged between the light emitting elements of the fourth light emitting element row, and hence, an increase in intervals between the light emitting elements of the fourth light emitting element row can be minimized.

Further, the embodiment may comprise a connection circuit to be electrically connected with the connecting portion of the head substrate. According to this construction, electrical connection with the outside of the head substrate can be easily made via the connection circuit. Further, the embodiment may comprise an electric circuit which is electrically connected with the connecting portion of the head substrate via or without via the connection circuit and outputs a drive signal that drives the light emitting elements in accordance with an inputted emission control signal. Here, the electric circuit may be disposed between the connecting portion of the head substrate and the connection circuit. According to this construction, the electric circuit can be arranged relatively close to the light emitting elements. Therefore, a drive signal with less dampening due to stray capacitance and the like can be supplied to the light emitting elements.

The electric circuit may be provided on the connection circuit. According to this construction, the area of the head substrate can be reduced since the electric circuit is not arranged on the head substrate. A driver board, on which the electric circuit is arranged, may be provided, and the electric circuit may be electrically connected with the connecting portion of the head substrate via the connection circuit.

According to this construction, a degree of freedom in designing the electric circuit can be improved since the electric circuit is provided on the driver board separate from the head substrate. Further, the connecting portion of the head substrate may collect the first and the second wirings at one location in the first direction. According to this construction, the size of the connecting portion can be reduced and a connecting construction of the head substrate with the outside can be simplified.

An embodiment of a line head according to another aspect of the invention comprises a head substrate and a connecting member. The head substrate includes light emitting elements grouped into light emitting element groups and wirings connected with the light emitting elements, and is provided with light emitting element group rows, each including the light emitting element groups aligned in the first direction, which are arranged in a second direction orthogonal to or substantially orthogonal to the first direction. The connecting member includes one end to be mounted in a one side area located more toward one side of the head substrate than the light emitting element groups in the second direction and another end to be drawn to an outside of the head substrate. The light emitting element groups are arranged with spaces defined between adjacent ones in the light emitting element group rows. The respective light emitting element group rows are displaced from each other in the first direction on the head substrate so that positions of the light emitting element groups in the first direction mutually differ. The respective wirings are drawn to the one side area. The wirings drawn to the one side area from one light emitting element group row via the other light emitting element group row are drawn passing through the spaces of the other light emitting element group row. The one end of the connecting member is connected with the wirings via or without via an electric circuit. Signals relating to an emission control signal outputted from a controller outside the head substrate can be inputted to the other end of the connecting member.

An embodiment of an image forming apparatus according to another aspect of the invention comprises a line head that includes a head substrate and a connecting member, and a controller. The head substrate includes light emitting elements grouped into light emitting element groups and wirings connected with the light emitting elements, and is provided with light emitting element group rows, each including the light emitting element groups aligned in the first direction, which are arranged in a second direction orthogonal to or substantially orthogonal to the first direction. The connecting member includes one end to be mounted in a one side area located more toward one side of the head substrate than the light emitting element groups in the second direction and another end to be drawn to an outside of the head substrate. The light emitting element groups are arranged with spaces defined between adjacent ones in the light emitting element group rows. The respective light emitting element group rows are displaced from each other in the first direction on the head substrate so that positions of the light emitting element groups in the first direction mutually differ. The respective wirings are drawn to the one side area. The wirings drawn to the one side area from one light emitting element group row via the other light emitting element group row are drawn passing through the spaces of the other light emitting element group row. The one end of the connecting member is connected with the wirings via or without via an electric circuit. Signals relating to an emission control signal outputted from the controller can be inputted to the other end of the connecting member.

In the embodiment (line head, image forming apparatus) thus constructed, the light emitting elements grouped into the respective light emitting element groups and the wirings connected with the light emitting elements are provided on the head substrate. The head substrate is provided with the light emitting element group rows, each including the light emitting element groups aligned in the first direction, which are arranged in the second direction orthogonal to or substantially orthogonal to the first direction. In the light emitting element group rows, the light emitting element groups are arranged with the spaces defined between adjacent ones. In addition, the respective light emitting element group rows are displaced from each other in the first direction so that the positions of the respective light emitting element groups mutually differ in the first direction. Accordingly, the wirings can be easily drawn to the one side area by passing the wirings drawn from one light emitting element group row to the one side area via the other light emitting element group row through the spaces of the other light emitting element group row. Here, the "one side area" is an area closer to the one side of the head substrate than the light emitting element groups in the second direction. Thus, the connecting member connected with the wirings via or without via the electric circuit can also be provided in this one side area, wherefore it is possible to simplify the production process of the line head and to suppress the production cost thereof.

A driver IC that converts the emission control signal into signals for driving the light emitting elements may be provided as the electric circuit on the head substrate, the one end of the connecting member may be connected with the wirings via the driver IC and the emission control signal may be inputted to the other end of the connecting member. In the case of such a construction, the driver IC can be arranged relatively close to the light emitting elements. Therefore, the drive signal with less dampening due to stray capacitance and the like can be supplied to the light emitting elements.

A driver IC that converts the emission control signal into a drive signal for driving the light emitting elements may be provided on a driver IC substrate different from the head substrate, the one end of the connecting member may be connected with the wirings and the other end of the connecting member may be connected with the driver IC to have the drive signal from the driver IC inputted thereto. In such a construction, the driver IC is provided on the driver IC substrate separate from the head substrate. Therefore, the driver IC can be relatively freely arranged and laid out, whereby the cost of the driver IC can be suppressed.

A driver IC that converts the emission control signal into a drive signal for driving the light emitting elements may be provided between the one end and the other end of the connecting member, the one end of the connecting member may be connected with the wirings, the emission control signal may be inputted to the other end of the connecting member, and the emission control signal inputted to the other end may be converted by the driver IC into the drive signal, which is outputted from the one end. In such a construction, the substrate can be made smaller since the driver IC need not be provided on the substrate, wherefore the line head can have a compact construction.

The respective wirings may be collectively drawn to one location in the first direction and the one end of the connecting member may be connected therewith. In the case of such a construction, it is sufficient to mount one connecting member on the substrate and to perform a process of mounting the connecting member once, wherefore the production cost can be suppressed.

The respective light emitting elements may be constructed such that they are driven by time-division driving. In the case of such a construction, the number of the driver IC can be reduced and the production cost can be suppressed.

Although the invention has been described with reference to specific embodiments, this description is not meant to be construed in a limiting sense. Various modifications of the disclosed embodiment, as well as other embodiments of the invention, will become apparent to persons skilled in the art upon reference to the description of the invention. It is therefore contemplated that the appended claims will cover any such modifications or embodiments as fall within the true scope of the invention.

What is claimed is:

1. A line head, comprising:

a head substrate;

a first light emitting element group which is arranged on the head substrate and includes a first light emitting element and a second light emitting element;

a first lens which images a light emitted from the first light emitting element group;

a second light emitting element group and a third light emitting element group which are spaced apart by a space in a first direction and located more toward one side in a second direction orthogonal to or substantially orthogonal to the first direction than the first light emitting element group on the head substrate;

a second lens which images a light emitted from the second light emitting element group;

a third lens which images a light emitted from the third light emitting element group;

a first wiring which is arranged through the space between the second and the third light emitting element groups on the head substrate and is electrically connected with the first light emitting element; and a second wiring which is arranged through the space between the second and the third light emitting element groups on the head substrate and is electrically connected with the second light emitting element;

wherein in a planar view, the first wiring and second wiring pass between the second lens and the third lens and are drawn from the first light emitting element group to a one side area located more toward the one side in the second direction than the second light emitting group and third light emitting element group.

2. The line head according to claim 1, wherein the first light emitting element group includes a first light emitting element row made up of light emitting elements which include the first light emitting element and are arranged in the first direction and a second light emitting element row made up of light emitting elements which include the second light emitting element and are arranged in the first direction, and the second light emitting element row is located closer to the one side area than the first light emitting element row.

3. The line head according to claim 2, comprising a fourth light emitting element group which is arranged in the first direction of the first light emitting element group, wherein the first wiring is first drawn toward an opposite side to the one side area from the first light emitting element group and then bent to pass between the first and the fourth light emitting element groups.

4. The line head according to claim 3, wherein the first light emitting element group includes a third light emitting element row which is located closer to the one side area than the second light emitting element row, and the second wiring is arranged between light emitting elements belonging to the third light emitting element row.

5. The line head according to claim 4, wherein the first light emitting element group includes a fourth light emitting element row which is located at a side of the first light emitting element row opposite to the one side area, and the first wiring is arranged between light emitting elements belonging to the fourth light emitting element row.

6. The line head according to claim 1, comprising a connection circuit which is electrically connected with a connecting portion arranged in the one side area of the head substrate.

7. The line head according to claim 6, comprising an electric circuit which is electrically connected with the connecting portion of the head substrate via or without via the connection circuit and is configured to output a drive signal that drives the light emitting elements in accordance with an inputted emission control signal.

8. The line head according to claim 7, wherein the electric circuit is disposed between the connecting portion of the head substrate and the connection circuit.

9. The line head according to claim 7, wherein the electric circuit is disposed on the connection circuit.

10. The line head according to claim 7, comprising a driver board on which the electric circuit is arranged, wherein the electric circuit is electrically connected with the connecting portion of the head substrate via the connection circuit.

11. The line head according to claim 1, wherein the first wiring and the second wiring are collected at one location in the first direction in the one side area.

12. An image forming apparatus, comprising:

a head substrate;

a first light emitting element group which is arranged on the head substrate and includes a first light emitting element and a second light emitting element;

a first lens which images a light emitted from the first light emitting element group;

a second light emitting element group and a third light emitting element group which are spaced apart by a space in a first direction and located more toward one side in the second direction orthogonal to or substantially orthogonal to the first direction than the first light emitting element group on the head substrate;

a second lens which images a light emitted from the second light emitting element group;

a third lens which images a light emitted from the third light emitting element group;

a first wiring which is arranged through the space between the second and the third light emitting element groups on the head substrate and is electrically connected with the first light emitting element;

a second wiring which is arranged through the space between the second and the third light emitting element groups on the head substrate and is electrically connected with the second light emitting element; and a controller which is configured to output an emission control signal which controls light emissions of the light emitting elements, wherein in a planar view, the first wiring and second wiring pass between the second lens and the third lens and are drawn from the first light emitting element group to a one side area located more toward the one side in the second direction than the second light emitting group and third light emitting group.

13. The image forming apparatus according to claim 12, comprising a connection circuit which is electrically connected with a connecting portion arranged in the one side area of the head substrate.

14. The image forming apparatus according to claim 13, comprising an electric circuit which is electrically connected with the connecting portion of the head substrate via or without via the connection circuit and is configured to output a drive signal that drives the light emitting elements in accordance with the emission control signal inputted from the controller.

* * * * *